US011986143B2

(12) United States Patent
Kim et al.

(10) Patent No.: US 11,986,143 B2
(45) Date of Patent: May 21, 2024

(54) DISH WASHER AND WATER SOFTENER FOR DISH WASHER

(71) Applicant: LG Electronics Inc., Seoul (KR)

(72) Inventors: Jinhong Kim, Seoul (KR); Minkyu Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 6 days.

(21) Appl. No.: 17/590,083

(22) Filed: Feb. 1, 2022

(65) Prior Publication Data

US 2022/0240748 A1 Aug. 4, 2022

(30) Foreign Application Priority Data

Feb. 1, 2021 (KR) ..... 10-2021-0014272

(51) Int. Cl.
*A47L 15/42* (2006.01)

(52) U.S. Cl.
CPC ..... *A47L 15/4231* (2013.01)

(58) Field of Classification Search
CPC ..... A47L 15/4229; A47L 15/4231
See application file for complete search history.

(56) References Cited

U.S. PATENT DOCUMENTS

2012/0011663 A1* 1/2012 Hanau ..... D06F 39/006 8/137
2015/0351605 A1 12/2015 Brignone

FOREIGN PATENT DOCUMENTS

| | | |
|---|---|---|
| CN | 107713937 | 2/2018 |
| DE | 3015728 | 10/1981 |
| DE | 102017207568 | 9/2018 |
| EP | 2630905 | 8/2013 |
| KR | 20130087858 | 8/2013 |
| WO | WO2014174451 | 10/2014 |

OTHER PUBLICATIONS

Extended European Search Report in European Appln. No. 22154159.2, dated Jun. 27, 2022, 11 pages.
Office Action in European Appln. No. 22154159.2, mailed on Mar. 18, 2024, 6 pages.

* cited by examiner

*Primary Examiner* — Joseph L. Perrin
*Assistant Examiner* — Kevin G Lee
(74) *Attorney, Agent, or Firm* — Fish & Richardson P.C.

(57) ABSTRACT

A water softener for a dishwasher includes a tank body having a regeneration tank that accommodates brine, an exchange tank that accommodates an ion exchange resin, and a flow path configured to supply water to the regeneration tank and the exchange tank. The water softener further includes a regeneration inlet in communication with the regeneration tank, an exchange inlet in communication with the exchange tank, and a switching valve mounted at the tank body and configured to open and close the regeneration inlet and the exchange inlet to switch the flow path. The switching valve includes a head configured to open and close the regeneration inlet and the exchange inlet. A sealing protrusion protrudes toward the head from a circumference of the regeneration inlet and is configured to contact the head to seal the regeneration inlet.

18 Claims, 21 Drawing Sheets

DISH WASHER AND WATER SOFTENER FOR DISH WASHER

CROSS-REFERENCE TO RELATED APPLICATIONS

The present application claims priority under 35 U.S.C. 119 and 35 U.S.C. 365 to Korean Patent Application No. 10-2021-0014272, filed on Feb. 1, 2021, the disclosure of which is hereby incorporated by reference in its entirety.

TECHNICAL FIELD

The present disclosure relates to a dish washer and a water softener for a dish washer.

BACKGROUND

A dish washer (dishwasher) is one of kitchen appliances that washes dishes by spraying high-pressure washing water through a washing nozzle to wash food or dirt remaining on the dishes.

In general, the dish washer includes a washing tank that provides a space for washing dishes, a sump provided below the washing tank to supply washing water to the washing tank while the washing water is stored, and a washing nozzle provided inside the washing tank to spray high-pressure washing water. Then, the washing water supplied from the outside is supplied to the sump, moves from the sump to the washing nozzle, and is sprayed into the inner space of the washing tank at high pressure.

In addition, the dish washer may be provided with a water softener for softening the washing water flowing into the sump in order to improve washing ability.

In Korean Patent Laid-Open No. 10-2013-0087858, a water softener for a dish washer is disclosed, and a structure for switching a flow path in a direction of an ion exchange resin tank and in a direction of a regeneration tank by the valve is disclosed. In particular, the valve is configured as a solenoid valve and has a structure in which a fixing member is provided at one end of the valve. Therefore, there is a structure in which, according to the operation of the valve, a normal water supply flow path through which water is supplied to the ion exchange resin tank without going through the regeneration tank by selectively opening and closing the opening of the flow path by the fixing member and a regeneration water supply flow path through which water flows in the ion exchange resin tank after passing through the regeneration tank for regeneration of the ion exchange resin are formed.

However, in this conventional technique, there is a problem in that the contact area between the fixing member and the periphery of the opening is wide, so that sufficient pressure for airtightness cannot be provided.

In addition, in a case where the contact area between the fixing member and the periphery of the opening is large, a gap is generated between the fixing member and the periphery of the opening by foreign substances contained in flowing water, so that airtightness cannot be guaranteed when opening and closing the flow path.

In addition, in a structure in which the fixing member and the periphery of the opening are in surface contact with each other, in a case where the elastically deformable fixing member is deformed or the periphery of the opening formed of a resin material does not ensure perfect flatness, there may be a problem that the airtightness between the fixing member and the opening cannot be achieved.

In addition, in a case where the airtightness around the opening by the fixing member is not effective, the brine from the regeneration tank may leak into the ion exchange resin tank in a state where the normal water supply flow path is switched, and thereby the washed dishes inside the washing room may be contaminated by brine and leave marks on the surface of the dish.

Meanwhile, there is a problem that, if the output of the valve is improved in order to increase the airtight pressure between the fixing member and the opening, the fixing member may be deformed in the long term, and thus the brine is leaked.

SUMMARY

An object of an embodiment of the present disclosure is to provide a dish washer that prevents contamination and marks on dishes by preventing the inflow of brine during general water supply, and a water softener for a dish washer.

An object of an embodiment of the present disclosure is to provide a dish washer that improves airtight performance between an inlet of an ion exchange resin tank and a valve, and a water softener for a dish washer.

An object of an embodiment of the present disclosure is to provide a dish washer in which sealing performance between the valve and the sealing protrusion is corrected by preventing a molding defect of the sealing protrusion in contact with the valve, and a water softener for a dish washer.

A water softener for a dish washer according to an embodiment of the present disclosure includes a tank body having a regeneration tank in which brine is accommodated, an exchange tank in which an ion exchange resin is accommodated, and a flow path configured to supply water to the regeneration tank and the exchange tank, a switching valve configured to be mounted on the tank body to switch the flow path, a regeneration inlet configured to be in communication with the regeneration tank and to be opened and closed by the switching valve, and an exchange inlet configured to be in communication with the exchange tank and to be opened and closed by the switching valve, in which the switching valve may include a head configured to be opened and closed the regeneration inlet and the exchange inlet, and a sealing protrusion which protrudes toward the head around the regeneration inlet and is in line contact with one surface of the head to seal the regeneration inlet may be provided on the circumference of the regeneration inlet.

A head accommodation part in which the head is movably disposed may be formed between the regeneration inlet and the exchange inlet, and the sealing protrusion may be formed to be spaced apart from the circumferential surface of the head accommodation part.

The regeneration inlet and the exchange inlet may be disposed at positions facing each other, and the head may selectively open and close the regeneration inlet and the exchange inlet by linear reciprocating motion.

The inner diameter of the exchange inlet may be formed larger than the size of the regeneration inlet, and the head may shield the regeneration inlet in contact with the circumference of the regeneration inlet and may be inserted inside the exchange inlet to shield the exchange inlet.

A sealing rib protruding along the circumference of the head and in contact with the inner surface of the exchange inlet to seal the airtight between the head and the exchange inlet may be formed on the circumferential surface of the head.

The sealing protrusion may include a rounded part formed to be rounded toward the most protruding end part of the sealing protrusion from the inside of the regeneration inlet and being in contact with the head; and an inclined part formed outside the regeneration inlet and extending obliquely outward from an end part of the rounded part.

The rounded part may be formed to pass the most protruding end part of the sealing protrusion to form a contact surface with the head, and the inclined part may be not in contact with the head.

The sealing protrusion may include an inner extension part extending from an end part of the rounded part and forming an inner surface of the regeneration inlet, and an outer extension part extending parallel to the inner extension part from an end part of the inclined part and forming an outer surface of the sealing protrusion.

The regeneration inlet and the exchange inlet may be positioned opposite to each other, and the inflow flow path through which water is supplied may communicate between the regeneration inlet and the exchange inlet.

The switching valve may include valve body, a rod mounted on the inside of the valve body to be capable of moving linearly and reciprocally, and the head is mounted on an end part thereof, and a spring elastically supporting the rod inside the valve body, and the head may be formed of an elastically deformable material.

The rod may include a first head fixing part formed at an end part of the rod and supporting the front surface of the head in contact with the sealing protrusion inside the head, a second head fixing part is formed at a position spaced apart from the first head fixing part and supporting the head from the outside to protrude, and a protrusion groove which is formed in a space between the first head fixing part and the second head fixing part and into which the insertion protrusion of the head is inserted.

A diameter of the first head fixing part may be formed to be smaller than the diameter of the regeneration inlet, and a diameter of the second head fixing part may be larger than the diameter of the regeneration inlet.

A diameter of the second head fixing part may be smaller than a diameter of an outer end of the sealing protrusion.

A valve mounting part to which the switching valve may be mounted from the outside is opened at the outside of the tank body, and the head may be mounted to be inserted into the valve mounting part.

A valve fixing part may be formed on both sides of the valve mounting part so that the switching valve is fixedly mounted, and fixing parts coupled to the valve fixing part may be formed on both sides of the valve body.

Inside the valve mounting part, a first space in which the rod is inserted and a flow path connected to the exchange tank is formed, a second space in which the head is movably disposed, and a third space in which a flow path connected to the regeneration tank is formed may be provided, in the first space, the second space, and the third space may be continuously disposed in the insertion direction of the switching valve, and the first space, the second space, and the third space may be located on an extension line of the central axis of the rod.

An exchange vertical flow path extending vertically toward the bottom surface of the tank body may be formed in the first space to be connected to the exchange tank, a regeneration vertical flow path extending vertically toward the bottom surface of the tank body may be formed in the third space to be connected to the regeneration tank, and an inflow flow path in which washing water flows may be connected to the second space positioned between the first space and the third space.

A dish washer may include a main body in which a washing tank forming a space for washing dishes is formed, a door configured to open and close the washing tank, a water jacket configured to be built into the side wall of the main body and storing water for washing, a water softener configured to be connected to the water jacket and to soften water supplied from the water jacket, a sump configured to be connected to the water softener and provided at the bottom of the washing tank to collect water inside the washing tank, and a nozzle connected to the sump to spray water into the washing station, in which the water softener may include a tank body having a regeneration tank in which brine is accommodated, an exchange tank in which an ion exchange resin is accommodated, and a flow path configured to supply water to the regeneration tank and the exchange tank, a switching valve configured to be mounted on the tank body and configured to switch a flow path so that water is supplied to the regeneration tank or the exchange tank, a regeneration inlet configured to be in communication with the regeneration tank and to be opened and closed by the switching valve, and an exchange inlet configured to be in communication with the exchange tank and to be opened and closed by the switching valve, the switching valve may include a head configured to open and close the regeneration inlet and the exchange inlet, and a sealing protrusion which protrudes toward the head around the regeneration inlet and is in line contact with one surface of the head to seal the regeneration inlet may be provided on the circumference of the regeneration inlet.

The water softener may further include a tank cover and a tank base configured to shield the open upper and lower surfaces of the tank body, and at least a portion of a flow path connected to the regeneration tank and the exchange tank is formed on the tank cover and the tank base.

The tank body may include a water inflow flow path communicating with a space between the regeneration inlet and the exchange inlet and through which the water of the water jacket is supplied; a recovery flow path connected to the exchange tank and configured to guide water in the exchange tank to the water jacket, and a water outflow flow path configured to connect one side of the water jacket and a water outlet connected to the sump to discharge water from the water jacket to the sump, the tank cover may shield the open upper surfaces of the water inflow flow path, the recovery flow path, and the water outflow flow path, and a water inflow port, a recovery port, and a water outflow port connected to the water jacket may be opened at positions corresponding to the water inflow flow path, the recovery flow path, and the water outflow flow path.

BRIEF DESCRIPTION OF THE DRAWINGS

FIG. 13 is an enlarged view illustrating part A of FIG. 9 in a state where the switching valve is turned on.

FIG. 14 is an enlarged view illustrating part B of FIG. 10 in a state where the switching valve is turned on.

DETAILED DESCRIPTION OF THE EMBODIMENTS

Hereinafter, specific embodiments of the present disclosure will be described in detail with drawings. However, the present disclosure cannot be said to be limited to the embodiments in which the spirit of the present disclosure is presented, and other disclosures that are degenerative by addition, change, deletion, or the like of other components or other embodiments included within the spirit scope of the present disclosure can be easily suggested.

Before the description, the direction is defined. In the embodiment of the present disclosure, the direction in which the door is located as illustrated in FIG. 1 can be defined as a front direction, the direction toward the main body with respect to the door can be defined as a rear direction, the direction toward the bottom surface on which the main body is installed can be defined as a lower direction, and the direction away from the bottom surface can be defined as an upper direction.

Figure 1:
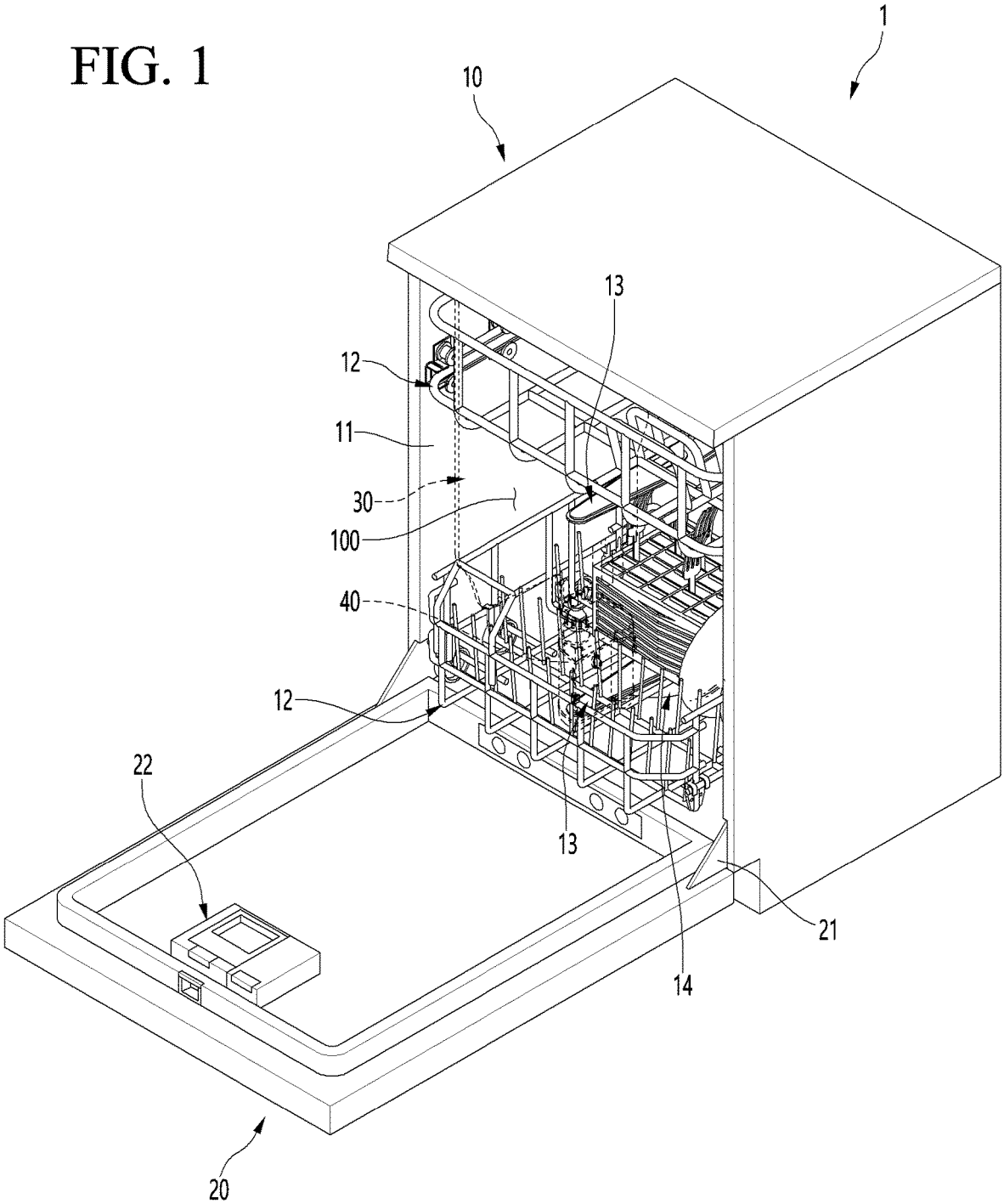
FIG. 1 is a perspective view illustrating a state where a door of a dish washer according to an embodiment of the present disclosure is opened.

FIG. 1 is a perspective view illustrating a state where a door of a dish washer according to an embodiment of the present disclosure is opened.

As illustrated in the drawings, the dish washer 1 according to the embodiment of the present disclosure may have an outer appearance formed by a main body 10 and a door 20. The main body 10 may be provided with a washing tank 11 having a space for washing dishes therein. In addition, the door 20 is rotatably mounted to the main body 10 and can open and close the washing tank 11 opened to the front.

The main body 10 may form the outer appearance of the dish washer and may have a different configuration according to the state where the dish washer is installed.

For example, as illustrated in FIG. 1, in a case where the dish washer 1 is configured as a free-standing type that is independently disposed in an indoor space, the main body 10 may include a plate-like configuration that forms an outer appearance. As another example, in a case where the dish washer 1 is configured as a built-in type that is embedded and mounted in furniture, or the like, the rest of the main body 10 except for the front surface is covered with furniture or the like, so the main body 10 may be configured in the shape of the frame except for the configuration constituting the plate-like outer appearance.

In addition, the door 20 may form an outer appearance of a front surface of the dish washer 1 in a closed state. In addition, if necessary, a panel forming an outer appearance may be mounted on the front surface of the door 20. A hinge 21 is provided at the lower end of the door 20 to be rotatably coupled to the lower end of the main body 10, and the door 20 may be configured to open and close the washing tank 11 by rotation.

In addition, a detergent input part 22 for inputting detergent may be formed on the rear surface of the door 20. In addition, a gasket may be provided around the rear surface of the door 20 so as to be in contact with the front surface of the main body 10 to seal between the washing tank and the door. Also, although not illustrated, a manipulation part for setting and manipulating the operation of the dish washer 1 may be provided in the door 20.

The washing tank 11 forms a washing space 100 in which dishes are washed, may be formed in a box shape with an open front surface and may occupy most of the inner region of the main body 10.

In addition, the washing tank 11 may be formed of a stainless material, and the dish basket 12 in which the dishes are stored may be disposed so as to be withdrawable. The dish basket 12 may be configured in such a way that a plurality of wires cross each other to facilitate washing of the stored dishes. The dish basket 12 may be formed in various shapes and may have a shape such as a shelf or a rack. In addition, a plurality of the dish baskets 12 may be disposed vertically.

A plurality of nozzles 13 for spraying water for washing dishes may be disposed inside the washing tank 11. For example, the nozzle 13 may be disposed between the upper and lower surfaces of the washing tank 11 and the dish baskets 12 disposed vertically. Accordingly, dishes stored in the dish basket 12 can be washed by the washing water sprayed in the vertical direction from the plurality of nozzles 13. Although not illustrated in detail, the nozzle 13 may have a rotatable structure and may have a structure in which a plurality of nozzles 13 are mounted on an arm structure formed to evenly spray washing water over a large area. In addition, a steam nozzle (not illustrated) for spraying steam for washing and drying dishes may be further provided inside the washing tank 11.

A sump 14 may be provided at the bottom of the washing tank 11. The sump 14 may be disposed below the main body 10, that is, in a space below the washing tank 11, and the opening of the sump 14 is located at the bottom of the washing tank 11, and thus is configured so that the falling water from the washing tank 11 flows therein. In addition, a filter is provided on the sump 14 to filter out foreign substances contained in the washing water.

In addition, although not illustrated in detail, a circulation pump for circulating the washing water may be provided in the sump 14. The circulation pump may suck in the water in the sump 14 and discharge the water toward the nozzle 13. Accordingly, the water from the sump 14 is continuously supplied to the nozzle 13 by the operation of the circulation pump, so that the washing water can be circulated and sprayed. In addition, a drain part through which the water of the sump is drained may be provided on the other side of the sump 14. Accordingly, washing water may be drained through the drain part during operation for washing or upon completion of operation. To this end, a flow path for the flow of washing water may be formed between the sump 14 and the circulation pump, the nozzle 13, and the drain part.

Meanwhile, although not illustrated, a heat pump may be provided under the main body 10. The heat pump may include a compressor for compressing the refrigerant, a condenser for dissipating and condensing the refrigerant, an expansion device for decompressing and expanding the refrigerant, and an evaporator for evaporating the refrigerant by absorbing ambient latent heat. The washing water and the washing tank may be heated by driving the heat pump. In addition, the heat pump may further include a refrigerant flow path switching valve and may heat the washing water by switching the refrigerant flow direction or induce condensation of moisture during drying after washing dishes. Of course, an electric heater may be provided to heat the washing water instead of the heat pump.

The main body 10 may be provided with a water jacket 30 for accommodating washing water. The water jacket 30 may be formed in a cylindrical shape that can accommodate washing water. For example, the water jacket 30 may be disposed to be in contact with one side wall of the washing tank 11 and may be disposed between the washing tank 11 and the outer surface of the main body 10.

In addition, the water jacket 30 may be connected to the water softener 40. The water softener 40 reduces the component of calcium of the washing water which is supplied, thereby minimizing the occurrence of stains on the dishes after washing dishes. The water softener 40 may be connected to the sump 14, and water from which the component of calcium has been removed by The water softener 40 is sprayed into the washing tank 11 to wash dishes. For example, The water softener 40 may be provided below the washing tank 11.

Hereinafter, the structures of the water jacket 30 and the water softener 40 will be described with reference to the drawings.

Figure 2:
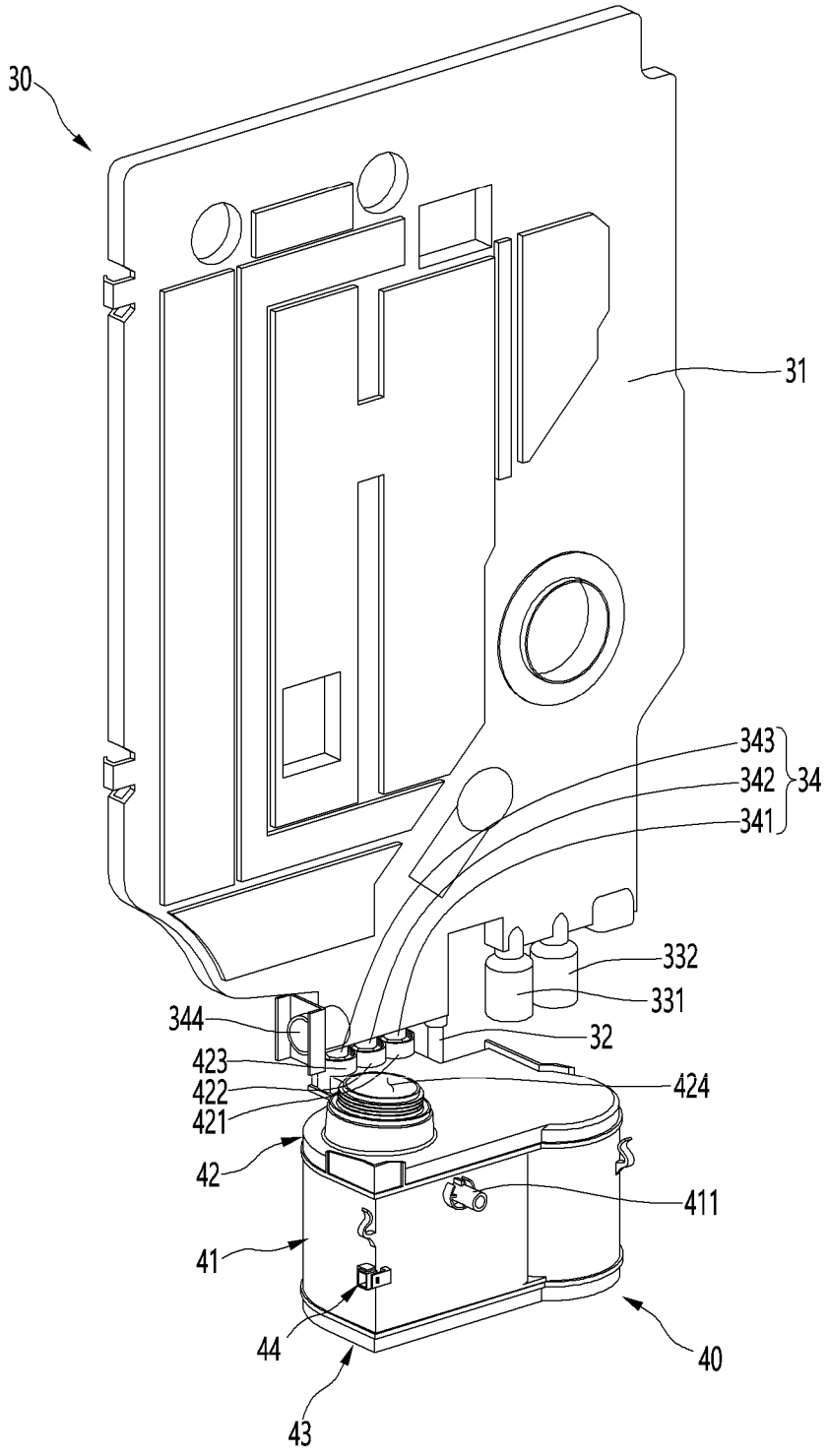
FIG. 2 is a perspective view illustrating a state where a water softener and a water jacket are combined according to an embodiment of the present disclosure.

FIG. 2 is a perspective view illustrating a state where a water softener and a water jacket are combined according to an embodiment of the present disclosure.

As illustrated in the drawing, the water jacket 30 may be formed to be thin and wide so as to be disposed inside the side wall of the main body 10 and may be formed as a plate shape that can be in contact with the side of the washing tank 11.

In addition, a space in which washing water can be accommodated is formed in the water jacket 30, and a flow path through which the water flowing into the water jacket 30 faces The water softener 40 may be formed. In order to form the shape of the water jacket 30 as described above, the water jacket 30 may be injection-molded with a resin material.

The water jacket 30 may selectively supply water to the water softener 40 as well as may store washing water. In addition, the water jacket 30 may be configured to heat the stored washing water while the washing water drained when the high-temperature washing water is drained passes through the water jacket. In addition, the water jacket 30 may reduce the drying time by condensing the water vapor in the washing tank 11 by using the stored cold washing water when the drying operation is performed after the washing operation is ended. The water jacket 30 may be referred to as a water tank, an air break, or a reuse tank.

The water jacket 30 may include a water jacket body 31 forming a space for storing washing water and a flow path between the sump 14 and The water softener 40. A water supply connection part 32 connected to a water supply flow path connected to an external water supply source may be formed on one side of the water jacket main body 31. In addition, a water supply valve 321 (in FIG. 17) is provided in the water supply connection part 32 or the water supply flow path connected to the water supply connection part 32 to adjust the water supply to the water jacket 30.

In addition, a drain connection part 331 in which water drained from the sump 14 flows may be formed on one side of the lower end of the water jacket 30 after the washing operation is completed. In addition, a drain hose connection part 332 connected to the drain hose may be formed to drain the water in the water jacket.

In addition, a plurality of connection parts 34 connected to the water softener 40 may be formed on the other side of the lower end of the water jacket 30. In detail, the connection part 34 may include an water inflow connection part 341 for supplying with water to The water softener 40, a recovery connection part 342 through which water passing through The water softener 40 is recovered to the water jacket 30, and a water outflow connection part 343 for supplying the washing water inside the water jacket 30 to the sump 14 through The water softener 40.

The water inflow connection part 341, the recovery connection part 342, and the water outflow connection part 343 may be sequentially disposed in sequence along the lower end of the water jacket 30. The water inflow connection part 341, the recovery connection part 342, and the water outflow connection part 343 may protrude at the same height, and the water inflow port 421, the recovery port 422, and the water outflow port 423 formed in The water softener 40 can be inserted simultaneously. The water inflow connection part 341 may be referred to as a first connection part, the recovery connection part 342 may be referred to as a second connection part, and the water outflow connection part 343 may be referred to as a third connection part, and the water inflow port 421 may be referred to as a first port, a recovery port 422 may be referred to as a second port, and the water outflow port 423 may be referred to as a third port.

Meanwhile, the connection part 34 may be provided with a connection part valve 344. The connection part valve 344 may adjust the opening and closing of the water inflow connection part 341, the recovery connection part 342, and the water outflow connection part 343 and may be mounted in a direction that intersects the extension direction of the connection part 34. As an example, the connection part valve 344 may be configured as a solenoid valve and may be configured to open and close the water inflow connection part 341, the recovery connection part 342, and the water outflow connection part 343 with one valve. Of course, it may also be possible for the connection part valve 344 to be independently mounted on each of the connection parts 34.

The water softener 40 is configured to soften the washing water supplied to the washing tank 11 and may be formed in a cylindrical shape that can be disposed under the washing tank 11.

In detail, the water softener 40 may include a tank body 41 forming a space in which water is accommodated, a tank cover 42 for shielding an open upper surface of the tank body 41, and a tank base 43 for shielding the opened lower surface of the tank body 41. The tank body 41 and the tank cover 42 may be injection-molded from a plastic material and may have a structure in which a flow path is formed for softening the washing water and regenerating the ion exchange resin.

The tank body 41 may be equipped with a detection device 44 for detecting the specific gravity of the brine in the tank. In addition, a water outlet 411 connected to the sump 14 may be formed at one side of the tank body 10.

The tank cover 42 may be formed to correspond to the shape of the open upper surface of the tank body 41. In addition, a plurality of ports 421, 422, and 423 connected to the connection part 34 may be formed on the tank cover 42. In addition, the tank cover 42 may have a salt input port 424 into which salt may be put. The salt input port 424 may be exposed to the bottom of the washing tank 11 and may be opened and closed by the input port cover 425 mounted inside the washing tank 11.

The tank base 43 may form a bottom surface of the water softener 40. In addition, the tank base 43 may be formed to correspond to the shape of the open lower surface of the tank body 41 and is coupled to the lower end of the tank body 41 to shield the open lower surface of the tank body 41.

Hereinafter, the water softener 40 will be described in more detail with reference to the drawings.

Figure 3:
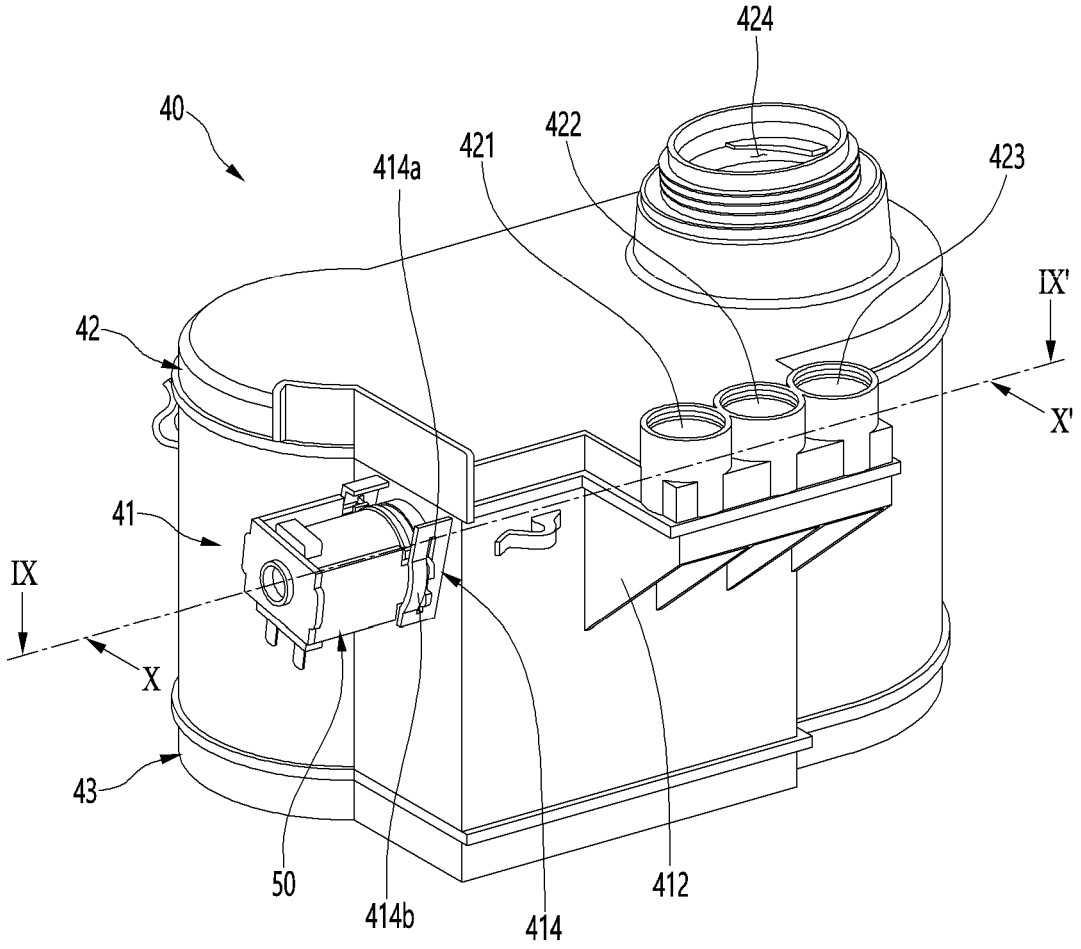
FIG. 3 is a perspective view viewed from one side of the water softener.
Figure 4:
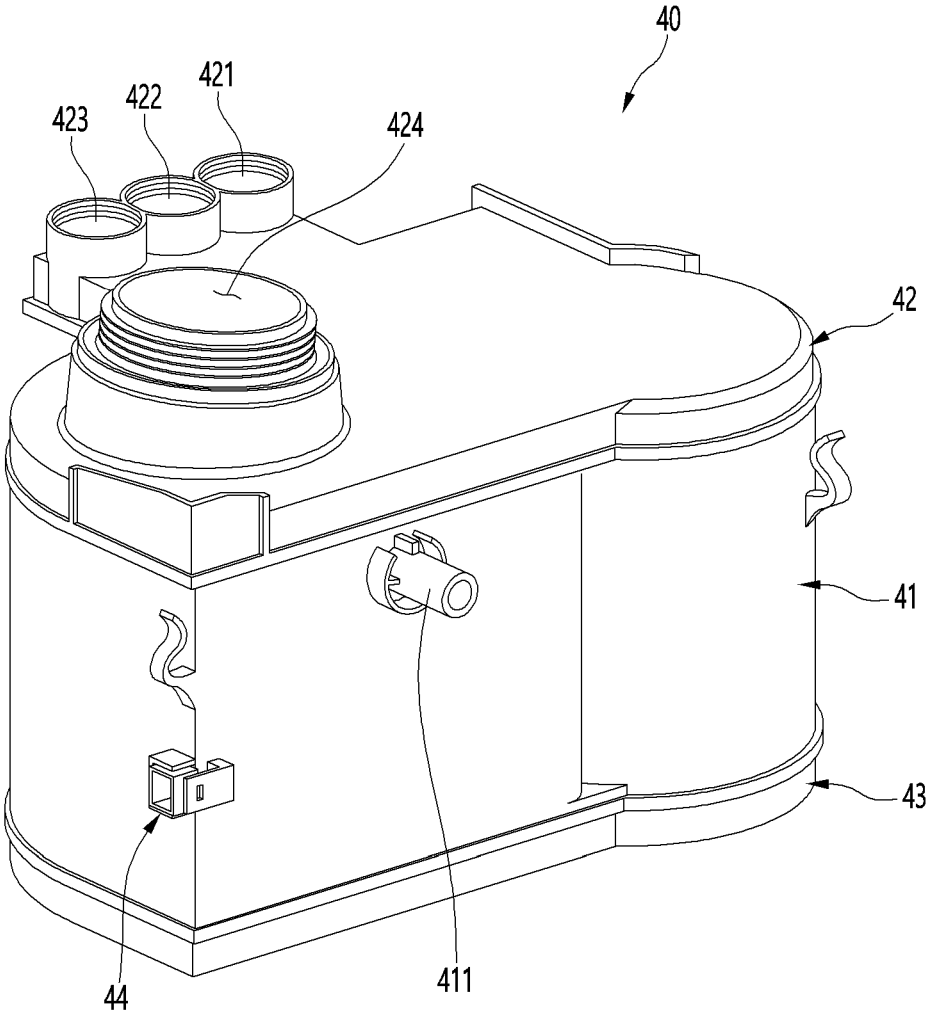
FIG. 4 is a perspective view viewed from the other side of the water softener.
Figure 5:
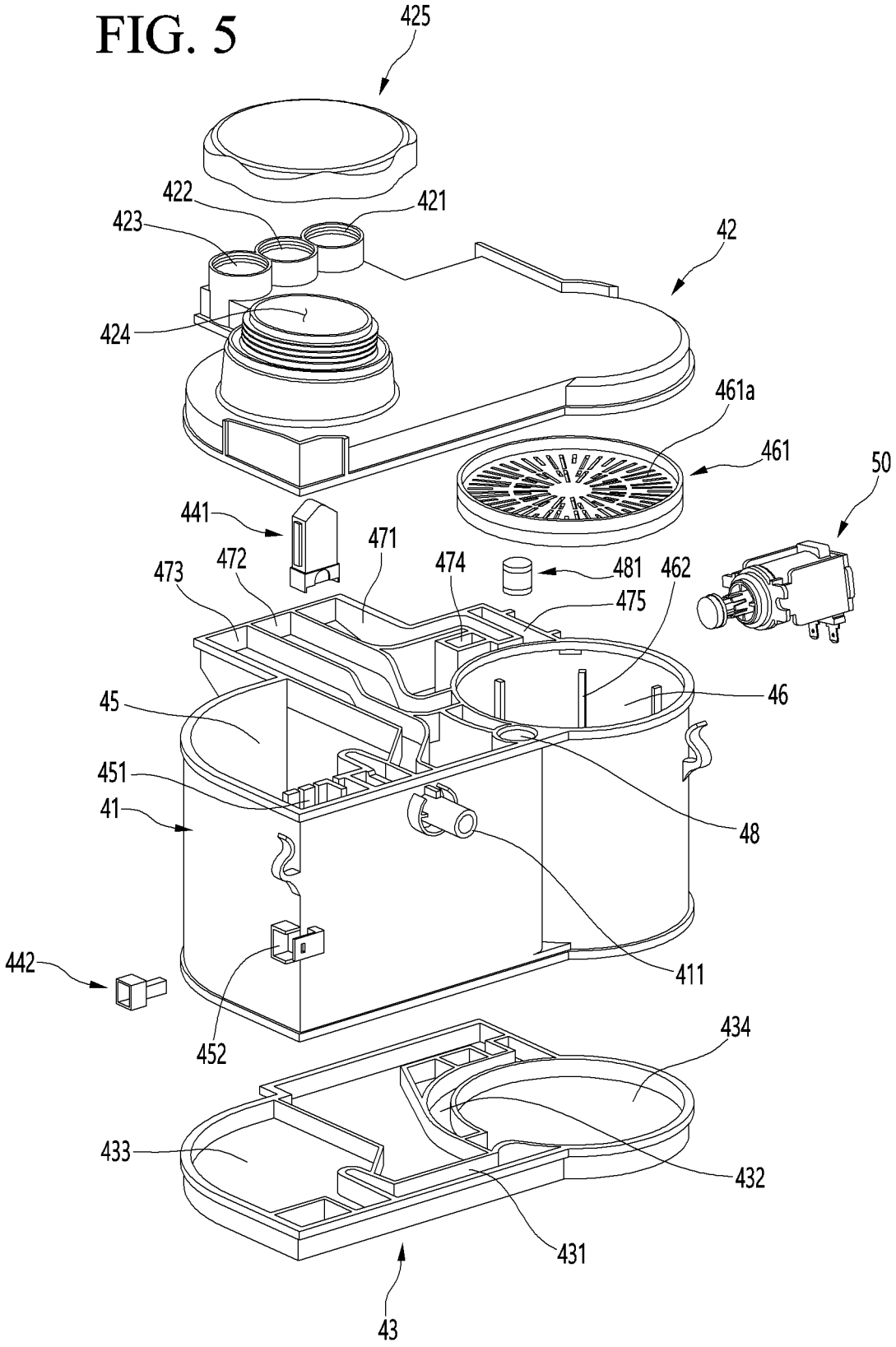
FIG. 5 is an exploded perspective view illustrating the water softener.

FIG. 3 is a perspective view viewed from one side of the water softener, FIG. 4 is a perspective view viewed from the other side of the water softener, and FIG. 5 is an exploded perspective view illustrating the water softener.

As illustrated in the drawings, the water softener 40 may be formed in a cylindrical shape in which water can be accommodated. In addition, the water softener 40 may include a tank body 41 that forms a space in which water is accommodated. In addition, the water softener 40 may further include a tank cover 42 for shielding the open upper surface of the tank body 41 and a tank base 43 for shielding the open lower surface of the tank body 41.

In addition, the inside of the water softener 40 may be divided into both left and right sides as a whole to form a regeneration tank 45 and an exchange tank 46. The exchange tank 46 may form a space in which an ion exchange resin for softening the inflow washing water is accommodated.

In detail, the exchange tank 46 may be formed in a shape in which the upper surface and lower surface are opened in the tank body 41. The exchange tank 46 may be formed in a cylindrical shape at one side of the tank body 41 and may form a space for accommodating the ion exchange resin and washing water therein. In addition, the tank cover 42 and the tank base 43 may be mounted on the tank body 41 to form upper and lower surfaces of the exchange tank 46. In other words, the open upper and lower surfaces of the exchange tank 46 formed in the tank body 41 may be shielded by the tank cover 42 and the tank body 41.

Meanwhile, the filtering member 461 may be provided inside the exchange tank 46. The filtering member 461 may be formed to have a shape corresponding to the cross-sectional area of the exchange tank 46. For example, the filtering member 461 may be formed in a disk shape and may be formed to have a diameter corresponding to a diameter of a cross-section of the exchange tank 46. In addition, the exchange tank 46 may be mounted to divide the inside of the exchange tank 46 up and down.

In addition, a plurality of filtering holes 461*a* may be formed in the filtering member 461. A plurality of filtering holes 461*a* may be formed radially with respect to the center of the filtering member 461. In addition, the filtering hole 461*a* may be formed to be smaller than the size of the ion exchange resin so that the ion exchange resin does not pass through, but water can freely pass therethrough.

In addition, a plurality of inner ribs 462 protruding inward may be formed on the inner surface of the exchange tank 46. The inner rib 462 may extend up and down, and a plurality of inner ribs 462 may be formed at regular intervals along the inner surface of the exchange tank.

In addition, the lower end of the inner rib 462 protrudes at a position spaced upward from the lower end of the exchange tank 46, and the lower end of the inner rib 462 can restrain the filtering member 461 from above. Accordingly, the filtering member 461 divides the exchange tank 46 up and down, and in this case, the filtering member 461 may be located below the exchange tank 46. In other words, the upper space of the exchange tank 46 divided based on the filtering member 461 may be formed to be larger than the lower space.

An ion exchange resin may be accommodated in a space below the exchange tank 46 divided by the filtering member 461. The ion exchange resin may change the washing water accommodated in the exchange tank 46 into soft water having excellent washing power. The ion exchange resin is a material having a charged functional group capable of exchanging ion and may be formed of a water-insoluble polymer or synthetic resin. In other words, the ion exchange resin (cation exchange resin) can be removed by adsorbing cation components (minerals called compounds of calcium) such as calcium and magnesium, which are hardness components contained in the washing water. For example, the ion exchange resin may be formed in the form of balls or granules and may be filled in a space below the filtering member 461. In addition, the size of the ion exchange resin may be smaller than the size of the filtering hole 461*a* of the filtering member 461.

Meanwhile, a regeneration tank 45 may be formed on the side of the exchange tank 46. The regeneration tank 45 inside the tank body 41 may be formed to be spaced apart from the exchange tank 46. The regeneration tank 45 may contain salt therein and may form a space in which brine for regeneration of the ion exchange resin is stored.

In the regeneration tank 45, a space for storing brine may be formed by the tank body 41 having open upper and lower surfaces, and the upper surface and the lower surface of the generation tank 45 may be formed by shielding the open upper surface and lower surface of the tank body 41 by the tank cover 42 and the tank base 43.

The regeneration tank 45 may be provided with a concentration detection device 44 for detecting the concentration of brine in the regeneration tank 45. The concentration detection device 44 may include a floater 441 (in FIG. 9) provided inside the regeneration tank 45 and a detection sensor 442 mounted on the outside of the regeneration tank 45.

The floater 441 may be formed of a material that can float on water and a magnet may be embedded therein. The floater 441 may be accommodated in a floater guide 451 formed on the inner surface of the tank body 41 and may be mounted to be movable up and down along the floater guide 451.

A sensor mounting part 452 in which the detection sensor 442 is mounted may be formed at a position corresponding to the lower end of the floater guide 451 on the outer surface of the tank body 41. The sensor mounting part 452 is recessed from the outside, and the detection sensor 442 may be inserted and mounted therein. For example, the detection sensor 442 may be configured as a Hall sensor for detecting a magnet and may be configured to detect a magnet built into the plotter 441.

Therefore, when the concentration of brine in the regeneration tank 45 is the set concentration or less, the floater 441 may sink and move to the position of the detection sensor 442, and, at this time, the detection sensor 442 detects this state and can detect that the brine concentration in the regeneration tank 45 is a set concentration or less.

The brine is for regeneration of the ion exchange resin and may be referred to as regeneration water. In a case where the concentration of the brine is a set concentration or less, the regeneration ability of the ion exchange resin may be reduced. Therefore, it is necessary to maintain the brine concentration in the regeneration tank 45 to a set concentration or more through the detection of the detection sensor 442.

The controller may output that the brine concentration of the regeneration tank 45 is a set concentration or less through a display or other output device according to the detection of the detection sensor 442 and may induce the user to replenish salt.

To this end, a salt input port 424 communicating with the regeneration tank 45 may be formed in the tank cover 42, and on the salt input port 424, an input port cover 425 for opening and closing the salt input port 424 can be mounted. The input port cover 425 may be exposed to the inside of the washing tank 11, and when the input port cover 425 is opened, the salt input port 424 is exposed to the inside of the washing tank 11, so that a user can supplement salt in the regeneration tank 45.

Meanwhile, the water softener 40 may include a water inflow flow path 471 which guides the water in the water jacket 30 toward the regeneration tank 45 and the exchange tank 46, a recovery flow path 472 which guides water passing through the exchange tank 46 back to the water jacket 30, and an water outflow flow path 473 which faces water discharged from the water jacket 30 toward the sump 14.

The water outflow flow path 473, the water inflow flow path 471, and the recovery flow path 472 may be formed in the tank body 41 and may be disposed side by side. In other words, the water outflow flow path 473, the water inflow flow path 471, and the recovery flow path 472 may be disposed in parallel and formed so that the side surfaces are in contact with each other. In addition, it may be understood that a portion of the tank body 41 is divided into a plurality of parts to form the water outflow flow path 473, the water inflow flow path 471, and the recovery flow path 472.

The water outflow flow path 473, the water inflow flow path 471, and the recovery flow path 472 may be formed between the regeneration tank 45 and the exchange tank 46 and protrude outward to have a structure connectable to the lower end of the connection part 34 of the water jacket 30. In addition, a portion of the water outflow flow path 473, the water inflow flow path 471, and the recovery flow path 472 may protrude from the outer surface of the tank body 41, and the flow path supporter 412 supporting the water outflow flow path 473, the water inflow flow path 471, and the recovery flow path (472) from the lower side may be formed in the tank body 41. The flow path supporter 412 may support the flow paths 471, 472, and 473 by connecting the outer surface of the tank body 41 and the lower surfaces of the flow paths 471, 472, and 473, respectively.

In addition, the water outflow flow path 473, the water inflow flow path 471, and the recovery flow path 472 may be opened upward. When the tank cover 42 and the tank body 41 are coupled, the open upper surface of the water outflow flow path 473, the inflow flow path 471, and the recovery flow path 472 can be shielded by the tank cover 42 and each of the water outflow flow path 473, the inflow flow path 471, and the recovery flow path 472 can form an independent flow path. In addition, the water inflow flow path 471 communicates with the water inflow port 421 and the water inflow connection part 341, the recovery flow path 472 communicates with the recovery port 422 and the recovery connection part 342, and the water outflow flow path 473 communicates with the water outflow port 423 and the water outflow connection part 343 to form a flow path connected between the water jacket 30 and the water softener 40.

In addition, a water outlet 411 communicating with an end part of the water outflow flow path 473 may be formed in the tank body 41. The water outlet 411 protrudes from the tank body 41 and may have a structure in which a pipe connected to the sump 14 is connected.

In addition, a connection flow path 48 connecting the regeneration tank 45 and the exchange tank 46 may be formed in the tank body 41, and a check valve 481 may be provided in the connection flow path 48. The check valve 481 has a structure that opens and closes in one direction so that brine moves from the regeneration tank 45 to the exchange tank 46 and may be mounted inside the connection flow path 48.

The connection flow path 48 extends from the upper end to the lower end of the tank body 41, and upper and lower surfaces may be opened. Accordingly, the upper end of the connection flow path 48 may communicate with the exchange tank 46 by the tank cover 42. In addition, the lower end of the connection flow path 48 may be connected to the regeneration tank 45 by the tank base 43. In this case, a first base flow path 431 connecting the lower end of the connection flow path 48 and the inner side of the regeneration tank 45 may be formed in the tank base 43.

In addition, a second base flow path 432 may be formed in the tank base 43 to direct water flowing in through the water inflow flow path 471 to the exchange tank 46. Accordingly, water flowing toward the exchange tank 46 through the connection flow path 48 may flow into the lower end of the exchange tank 46 through the second base flow path 432.

Meanwhile, the tank base 43 is in close contact with the circumference of the open lower surface of the tank body 41 corresponding to the regeneration tank 45, and a regeneration tank bottom surface 433 that shields the open lower surface of the regeneration tank 45 may be formed. In addition, the tank base 43 is in close contact with the circumference of the opened lower surface of the tank body 41 corresponding to the exchange tank 46, and the exchange tank bottom surface 434 to shield the open lower surface of the exchange tank 46 may be formed.

In addition, a switching valve 50 may be mounted on one side of the tank body 41. The switching valve 50 is configured to switch the flow path so that water flowing therein through the water inflow flow path 471 selectively flows into the regeneration tank 45 or the exchange tank 46. For example, the switching valve 50 may be configured as a solenoid valve.

The water flowing into the water inflow flow path 471 by the operation of the switching valve 50 may flow into the regeneration tank 45 or the water inflow flow path 471. Accordingly, the path through which water flows inside the water softener 40 by the switching valve 50 may be converted into a regeneration flow path or a general flow path.

The switching valve 50 may be mounted on the tank body 41 from the outside of the tank body 41 and may be detachably configured as necessary.

Hereinafter, the structure of the switching valve 50 and the mounting structure of the switching valve 50 will be described in more detail with reference to the drawings.

Figure 6:
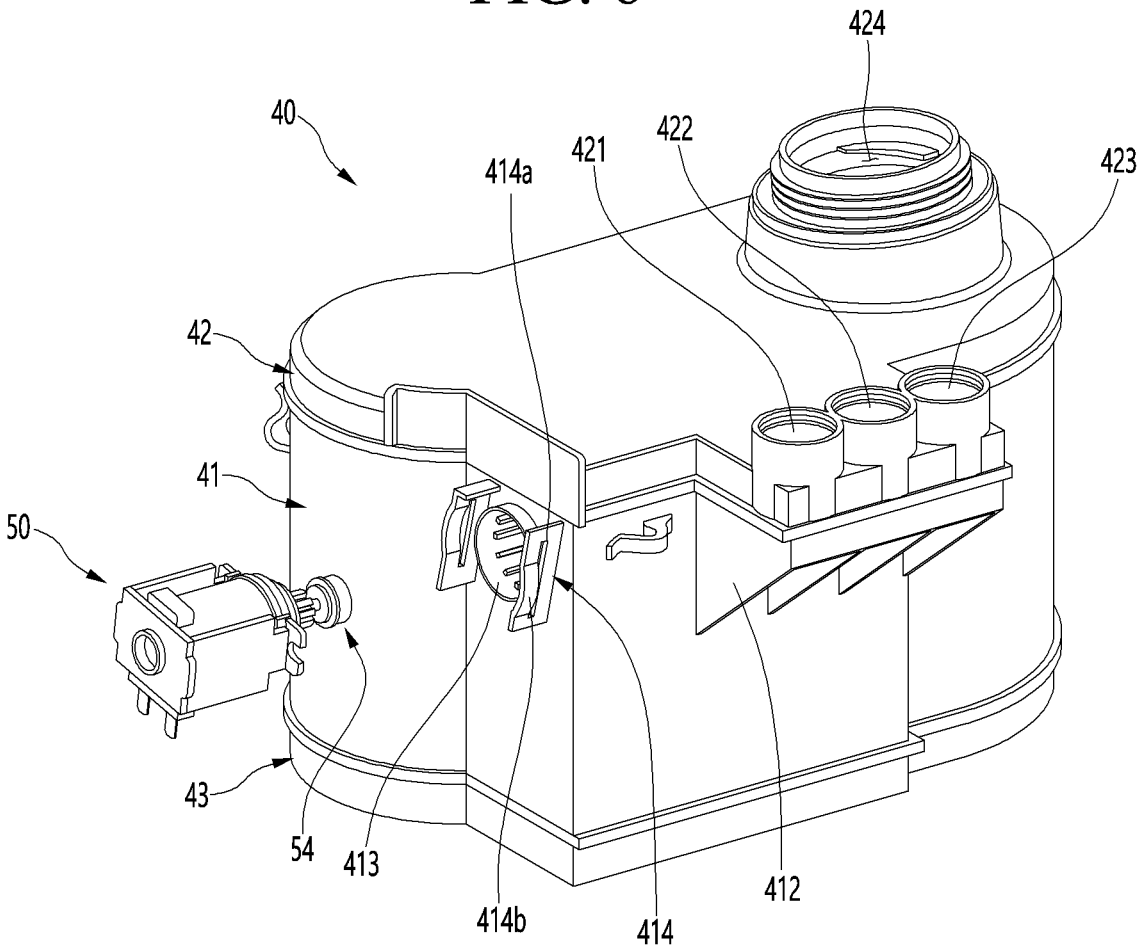
FIG. 6 is an exploded perspective view illustrating a coupling structure of a switching valve, which is one configuration of The water softener.
Figure 7:
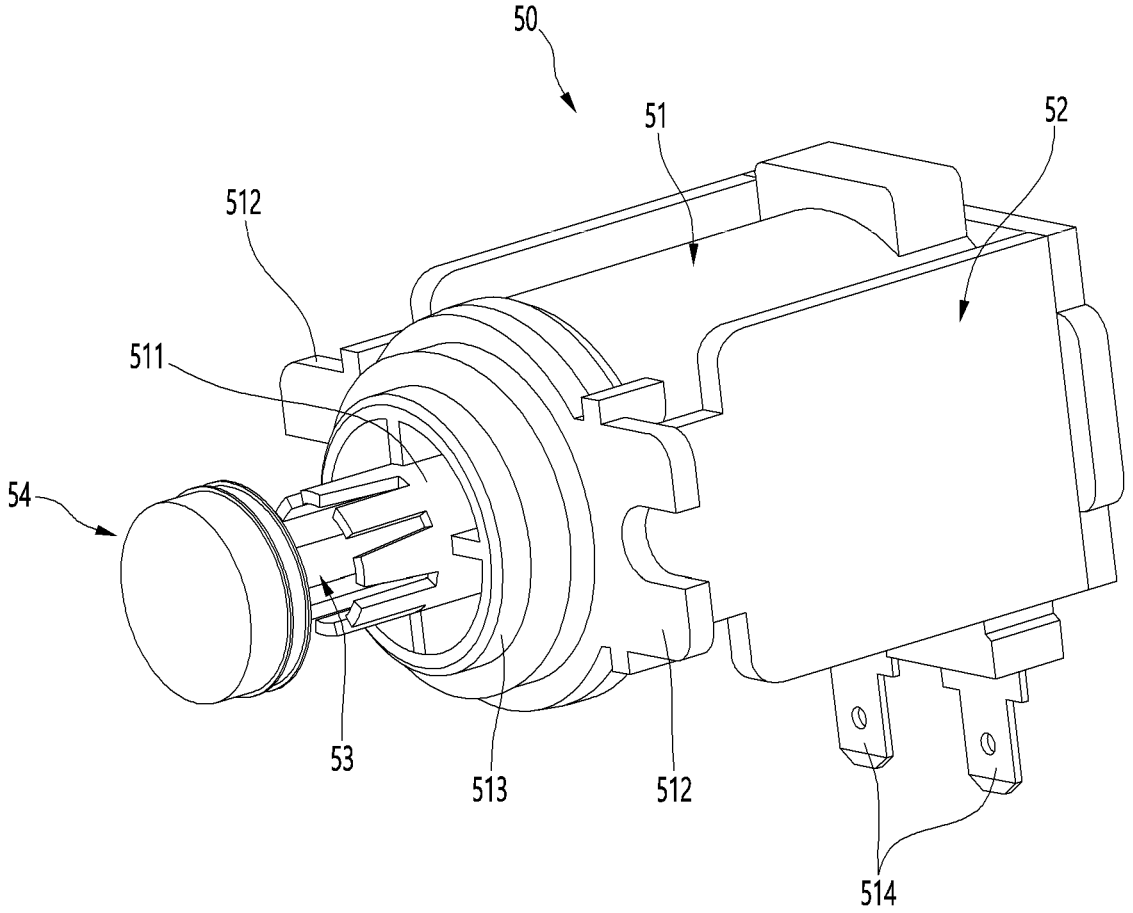
FIG. 7 is a perspective view illustrating the switching valve.
Figure 8:
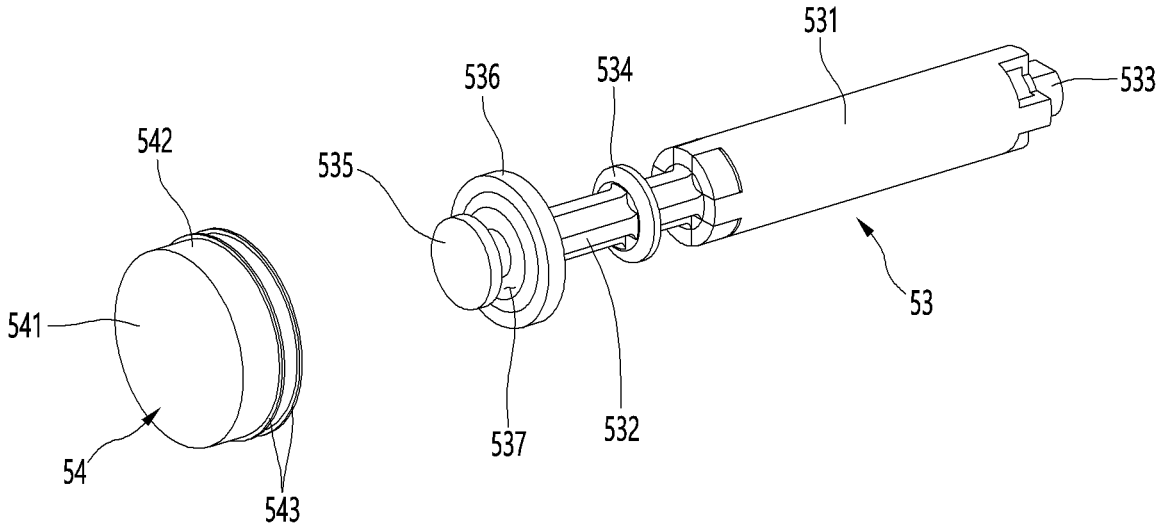
FIG. 8 is an exploded perspective view illustrating the structure of a valve rod and a valve head, which are major components of the switching valve.

FIG. 6 is an exploded perspective view illustrating a coupling structure of a switching valve, which is one configuration of the water softener, FIG. 7 is a perspective view illustrating the switching valve, and FIG. 8 is an exploded perspective view illustrating the structure of a valve rod and a valve head, which are major components of the switching valve.

As illustrated in the drawing, a valve mounting part 413 to which the switching valve 50 is mounted may be formed on one side of the tank body 41. The valve mounting part 413 is opened laterally so that a portion of the switching valve 50 may be inserted thereinto.

In addition, valve restraint parts 414 for restraining the switching valve 50 may be formed on both sides of the valve mounting part 413. The valve restraint part 414 may be disposed to face each other on both sides with respect to the valve mounting part 413 and may be formed in a shape symmetrical to each other. The valve restraining part 414 is formed in a plate shape protruding outward and may extend in the vertical direction. In addition, a slit 414*a* into which the fixing part 512 protruding to the outside of the switching valve 50 is inserted may be formed in the valve restraining part 414. The slit 414*a* may extend in the vertical direction and may extend so as to be rotatable in a state where the fixing part 512 is inserted.

In addition, a fixing part groove 414*b* evacuated when the fixing part 512 is inserted may be recessed outwardly in the central part of the valve restraining part 414. Accordingly, when the switching valve 50 is inserted into the valve mounting part 413, the fixing part 512 may be inserted into the slit 414*a* through the fixing part groove 414*b*. Then, the switching valve 50 is rotated while the fixing part 512 is inserted into the slit 414*a* so that the fixing part 512 is constrained to the slit 414*a*, so that the switching valve 50 can be fixedly mounted. Accordingly, the switching valve 50 may be configured to be easily detached and mounted as needed for failure of the switching valve 50 or servicing of The water softener 40.

The switching valve 50 may include a valve body 51 having a general solenoid valve structure and a valve bracket 52 coupled to surround the valve body 51 and fixing the switching valve 50 to the tank body 41. Further, the valve body 51 is provided with a rod 53 protruding or retracted according to the driving of the switching valve 50 and a spring 515 (in FIG. 11) for elastically supporting the rod 53, and a head 54 for opening and closing the flow path may be mounted at an end part of the rod 53.

In detail, the switching valve 50 may be formed in a cylindrical shape, and the end part of the switching valve 50 to which the rod 53 is mounted may be configured to be inserted into the valve mounting part 413. In addition, a rod guide 511 into which the rod 53 is inserted and mounted may be formed inside the opening of the switching valve 50.

In addition, the fixing parts 512 protruding laterally may be formed on both sides of the valve body 51. The fixing part 512 may be provided at an open end of the valve body 51 or may be separately formed and mounted on the valve body 51. The fixing part 512 may be formed in a size that can be inserted into the slit 414*a*. In addition, a screw groove to which a screw is fastened may be further formed in the fixing part 512. In a state where the fixing part 512 is mounted on the slit 414*a*, the switching valve 50 may be more firmly fixed by fastening a screw to the screw groove.

In addition, a sealing member 513 that is sealed with the valve mounting part 413 may be provided around the opened circumference of the switching valve 50. In a state where the switching valve 50 is mounted by the sealing member 513, an airtight seal between the valve mounting part 413 and the switching valve 50 may prevent water leakage.

In addition, a terminal part 514 to which a power cable is connected may be exposed at one end of the switching valve 50, and the terminal part 514 is provided on a surface opposite to the surface on which the rod guide 511 is formed, so that the switching valve 50 may be exposed to the outside in a mounted state.

The valve bracket 52 may be configured to support a surface opposite to the opened surface of the valve body 51 and left and right side surfaces of the valve body 51. The valve bracket 52 may be connected to the fixing part 512 and may allow the valve body 51 to maintain a more rigidly mounted state.

The rod 53 may be inserted into the rod guide 511 and may extend to protrude outside the rod guide 511. In this case, the length of the rod 53 may be extended so that the head 54 mounted on the end part of the rod 53 can open and close a regeneration inlet 621 to be described below. The stroke of the rod guide 511 may be configured to shield the regeneration inlet 621 when the switching valve is in an OFF state, and open the regeneration inlet 621 when the switching valve is in an ON state.

Looking at the structure of the rod 53 in more detail, the rod 53 may include a rod inner 531 which is accommodated inside the valve body 51 and a rod outer 532 which protrudes to the outside through the rod guide 511 at an end part of the rod inner 531.

The rod inner 531 may reciprocate linearly in response to the operation of the switching valve 50 inside the valve body 51. In addition, a spring coupling part 533 coupled to the spring 515 may protrude from the rear end of the rod inner 531. Accordingly, the rod 53 may be elastically supported by the spring 515 so that the head 54 may be pressed to contact the regeneration inlet 621. The rod outer 532 may pass through the rod guide 511 and extend to the outside of the valve body 51. At this time, the outer diameter of the rod outer 532 is formed to be smaller than the outer diameter of the rod inner 531 and formed to reduce resistance when the water flowing through the water inflow flow path 471 will flow in a direction crossing the rod outer 532.

In addition, a guide part 534 protruding outward may be formed in the rod outer 532. The guide part 534 may be formed in a disk shape corresponding to the inner diameter of the rod guide 511. Accordingly, the guide part 534 may be in contact with the inner surface of the rod guide 511 to prevent the rod 53 from flowing when the rod 53 moves.

Meanwhile, a first head fixing part 535 and a second head fixing part 536 for mounting the head 54 may be formed at an end part of the rod outer 532. The first head fixing part 535 is formed at the extended end part of the rod outer 532 and may have a disk shape. In addition, the second head fixing part 536 is formed at a position spaced apart from the first head fixing part 535 and may protrude outward more than the first head fixing part 535 along the circumference of the rod outer 532. In addition, between the first head fixing part 535 and the second head fixing part 536, a protrusion groove 537 into which the insertion projection 545 (in FIG. 15) of the head 54 is inserted may be formed. Accordingly, in a state where the head 54 is mounted on the end part of the rod 53, the first head fixing part 535 is inserted into the head 54, and the second head fixing part 536 may support the head 54 from the outside.

The head 54 may be formed of rubber or an elastic material such as rubber and may selectively contact the regeneration inlet 621 to open and close the regeneration inlet 621. The head 54 may include a head front surface 541 in contact with the regeneration inlet 621 and a head circumferential surface 542 extending along the circumference of the head front surface 541 to form a side circumference of the head 54.

The head front surface 541 may be formed in a circular plane to provide a surface that contacts the sealing protrusion 64 to be described below and shields the regeneration inlet 621. In addition, the head front surface 541 is formed to be at least larger than the diameter of the regeneration inlet 621 and may have a diameter larger than the outer diameter of the sealing protrusion 64, which will be described below.

The head circumferential surface 542 may extend to the second head fixing part 536, and an insertion protrusion 545 may protrude from an inner surface of the head circumferential surface 542. The insertion protrusion 545 may be inserted between the first head fixing part 535 and the second head fixing part 536, that is, inside the protrusion groove 537 when the head 54 is mounted.

Meanwhile, a sealing rib 543 may be formed on the outer surface of the head circumferential surface 542. The sealing rib 543 may protrude outward along the head circumferential surface 542. Accordingly, the sealing rib 543 may be formed to shield the exchange inlet 622 toward the exchange tank 46 when the switching valve 50 is turned on. When the switching valve 50 is turned on, the sealing rib 543 comes into contact with the inner circumferential surface of the exchange inlet 622 and may block the inflow of water into the exchange tank 46. A plurality of the sealing ribs 543 may be spaced apart to have a structure for sealing the exchange inlet 622 in multiple numbers.

Hereinafter, the opening/closing state of the flow path according to the operation of the switching valve 50 will be described with reference to the drawings.

Figure 9:
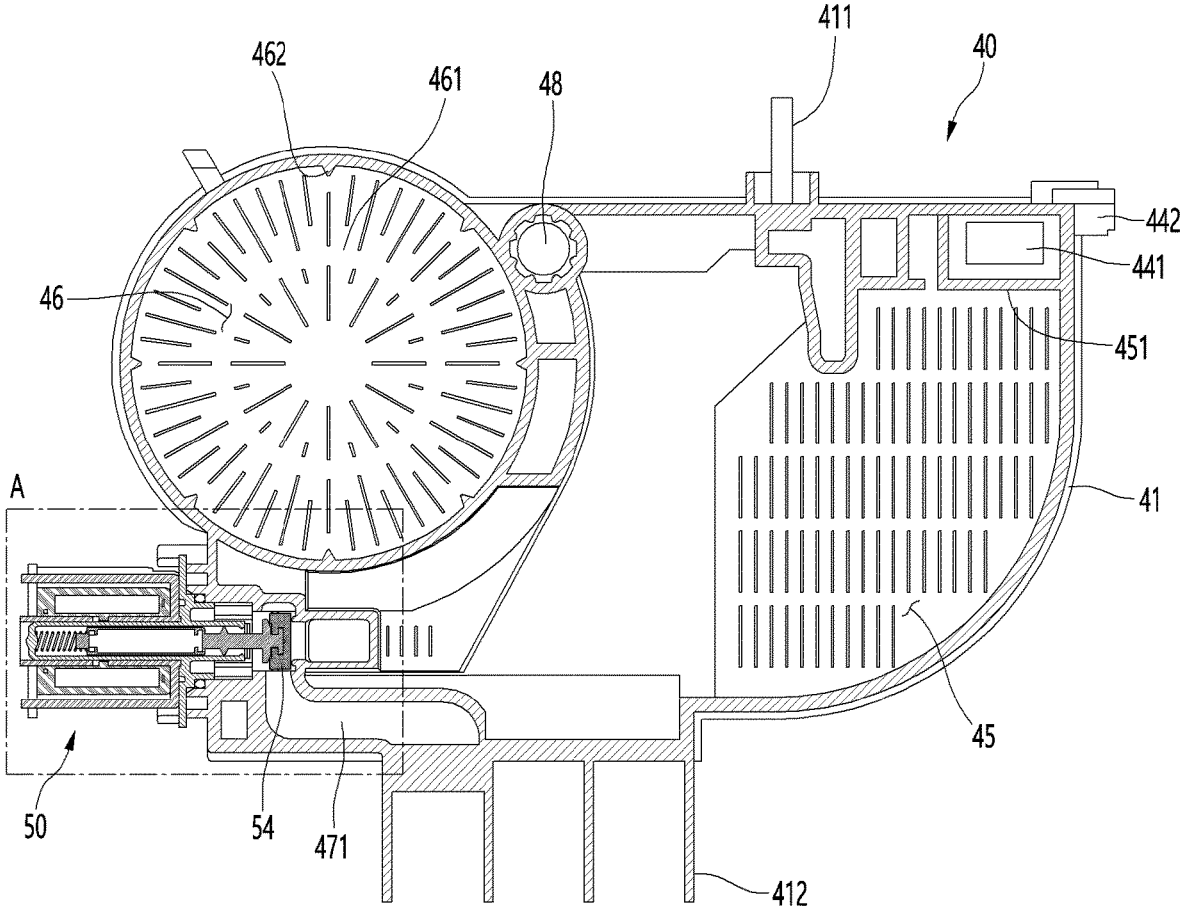
FIG. 9 is a cross-sectional view taken along line IX-IX' of FIG. 3.
Figure 10:
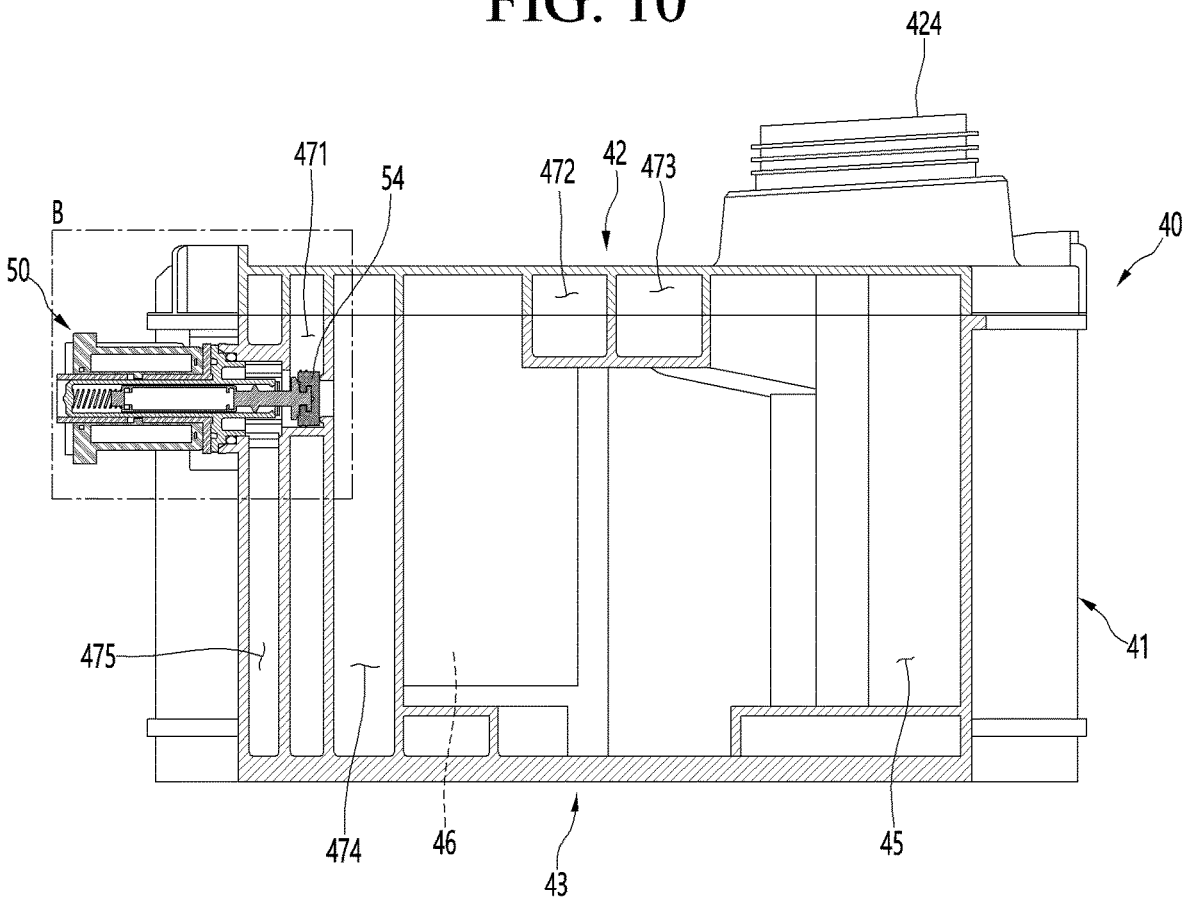
FIG. 10 is a cross-sectional view taken along line X-X' of FIG. 3.

FIG. 9 is a cross-sectional view taken along line IX-IX' of FIG. 3 and FIG. 10 is a cross-sectional view taken along line X-X' of FIG. 3.

As illustrated in the drawings, in a state where the switching valve 50 is mounted, the head 54 may be located at an end part of the water inflow flow path 471. In addition, the end part of the water inflow flow path 471 may be in communication with the regeneration inlet 621 (in FIG. 13) and the exchange inlet 622 (in FIG. 13). Meanwhile, the regeneration inlet 621 and the exchange inlet 622 may be disposed to face each other and may be opened in a direction crossing the open end part of the water inflow flow path 471.

In addition, in a state where the switching valve 50 is mounted, the head 54 is moved between the regeneration inlet 621 and the exchange inlet 622 and thus may selectively shield one of the regeneration inlet 621 and the exchange inlet 622.

In addition, the regeneration inlet 621 may communicate with a regeneration vertical flow path 474 that forms a regeneration flow path toward the regeneration tank 45. The regeneration vertical flow path 474 may be opened in a direction crossing the opening direction of the regeneration inlet 621 and may extend vertically from the tank body 41. In addition, the opened upper surface of the regeneration vertical flow path 474 communicates with the regeneration inlet 621, and the open lower surface of the regeneration vertical flow path 474 communicates with the passage connected to the regeneration tank 45 so that water passing through the regeneration vertical flow path 474 may flow into the regeneration tank 45. In this case, a passage connecting the regeneration vertical flow path 474 and the regeneration tank 45 may be formed in the tank body 41 or the tank base 43.

Meanwhile, the exchange inlet 622 may communicate with the exchange vertical flow path 475 forming a general flow path toward the exchange tank 46. The exchange vertical flow path 475 may be opened in a direction crossing the opening direction of the exchange inlet 622 and may extend vertically from the tank body 41. In addition, the open upper surface of the exchange vertical flow path 475 communicates with the exchange inlet 622, and the open lower surface of the exchange vertical flow path 475 may communicate with a passage connected to the exchange tank 46, that is, the second base flow path 432. Accordingly, water passing through the exchange inlet 622 and the exchange vertical flow path 475 may flow into the exchange tank 46.

In such a flow path structure, a flow path switching and water supply structure according to the operation of the switching valve 50 will be described in more detail with reference to the drawings.

Figure 11:
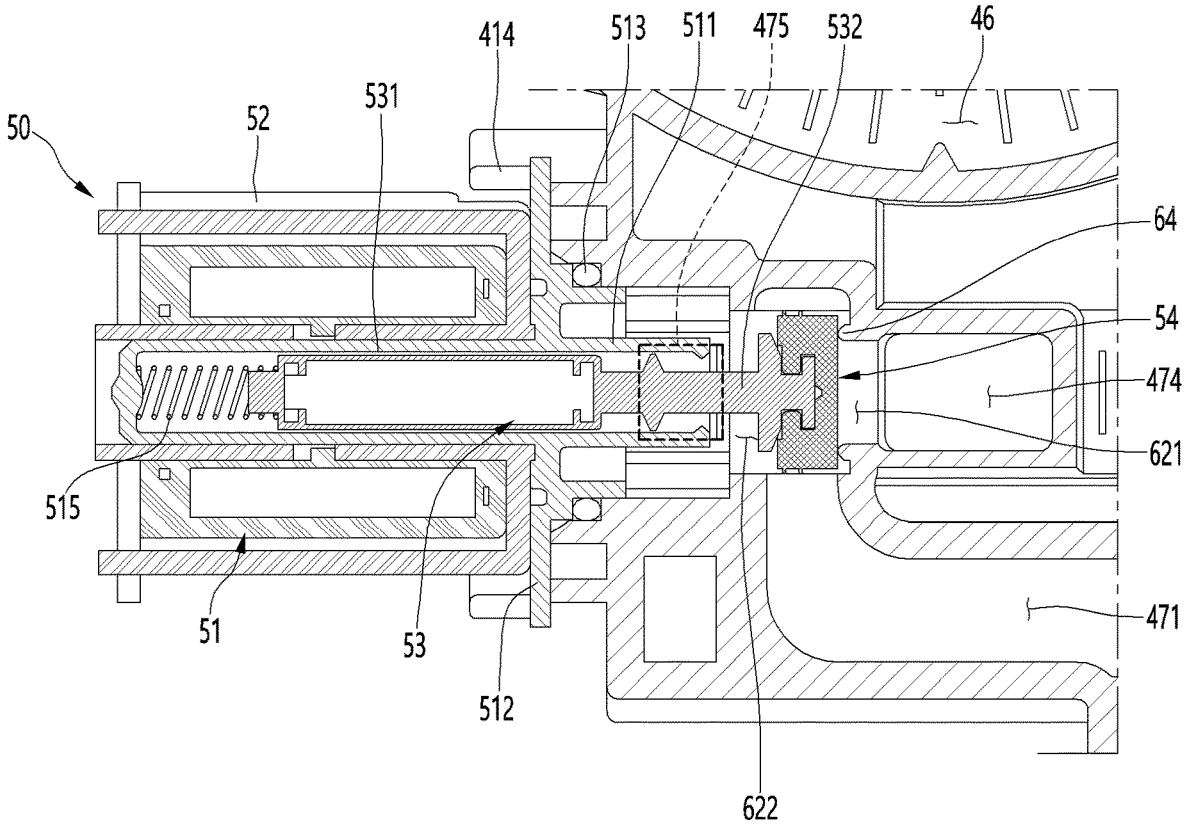
FIG. 11 is an enlarged view illustrating part A of FIG. 9 in a state where the switching valve is turned off.
Figure 12:
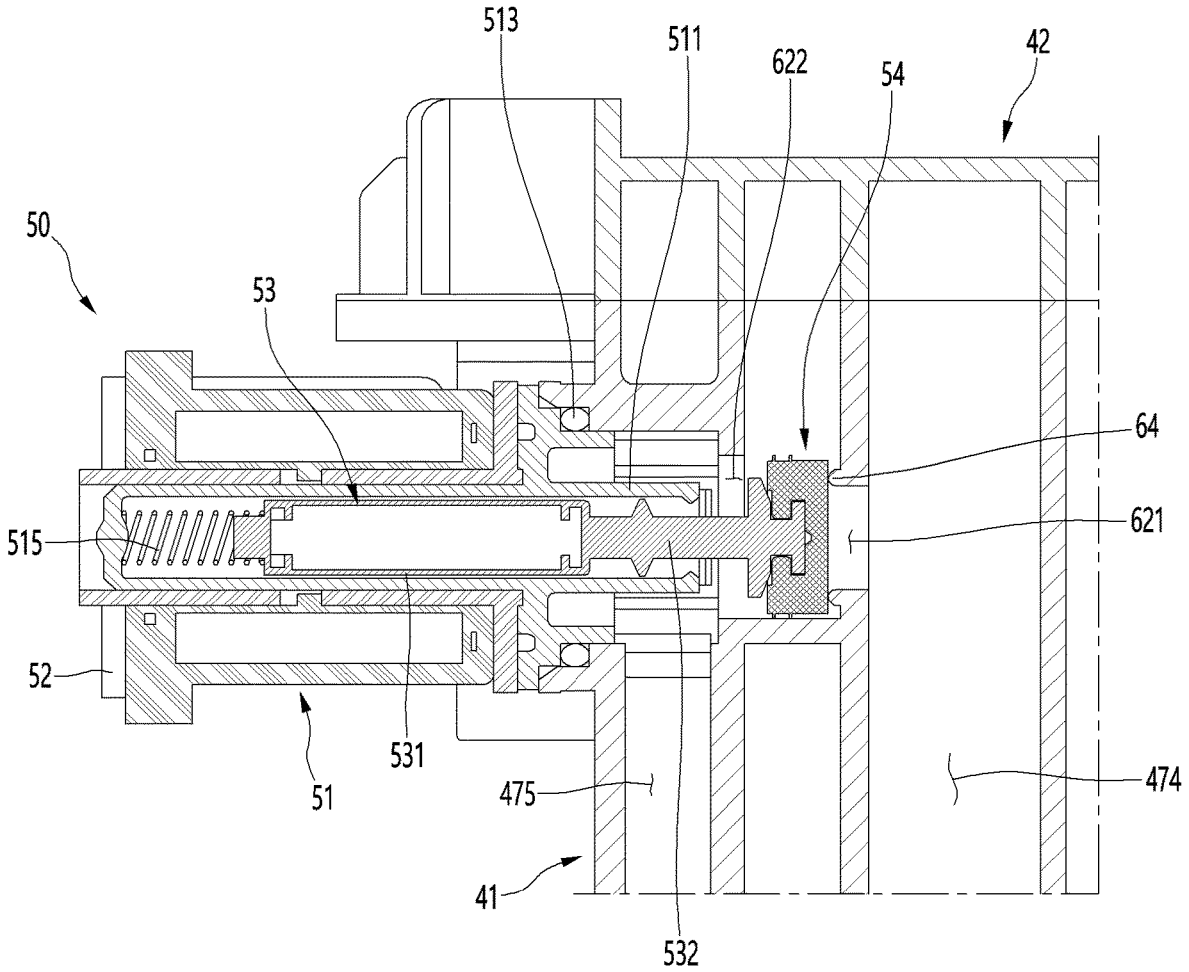
FIG. 12 is an enlarged view illustrating part B of FIG. 10 in a state where the switching valve is turned off.

FIG. 11 is an enlarged view illustrating part A of FIG. 9 in a state where the switching valve is turned off, and FIG. 12 is an enlarged view illustrating part B of FIG. 10 in a state where the switching valve is turned off.

As illustrated in the drawing, in a state where the switching valve 50 is turned off, the head 54 may shield the regeneration inlet 621. At this time, the head front surface 541 may be in a state of completely shielding the regeneration inlet 621 in a state of being in close contact with the sealing protrusion 64 formed around the regeneration inlet 621. At this time, since the switching valve 50 is in the OFF state, the head 54 may be pressed toward the sealing protrusion 64 by the elastic force provided by the spring 515 inside the switching valve 50 and the head 54 and the sealing protrusion 64 can guarantee an airtight state.

In addition, in a state where the head 54 shields the regeneration inlet 621, the exchange inlet 622 is maintained in an open state. Accordingly, the water inflow flow path 471 is in communication with the exchange inlet 622 and communicates with the exchange inlet 622, the exchange vertical flow path 475, the second base flow path 432, and the exchange tank 46. and then may be in a state where water can be supplied to the exchange tank 46.

As illustrated in FIGS. 11 and 12 by the head 54 while the switching valve 50 is not operated and maintained in an off state, the regeneration inlet 621 is maintained in a closed state, and the water flowing into The water softener 40 through the water inflow flow path 471 may be supplied to the inside of the exchange tank 46.

Figure 13:
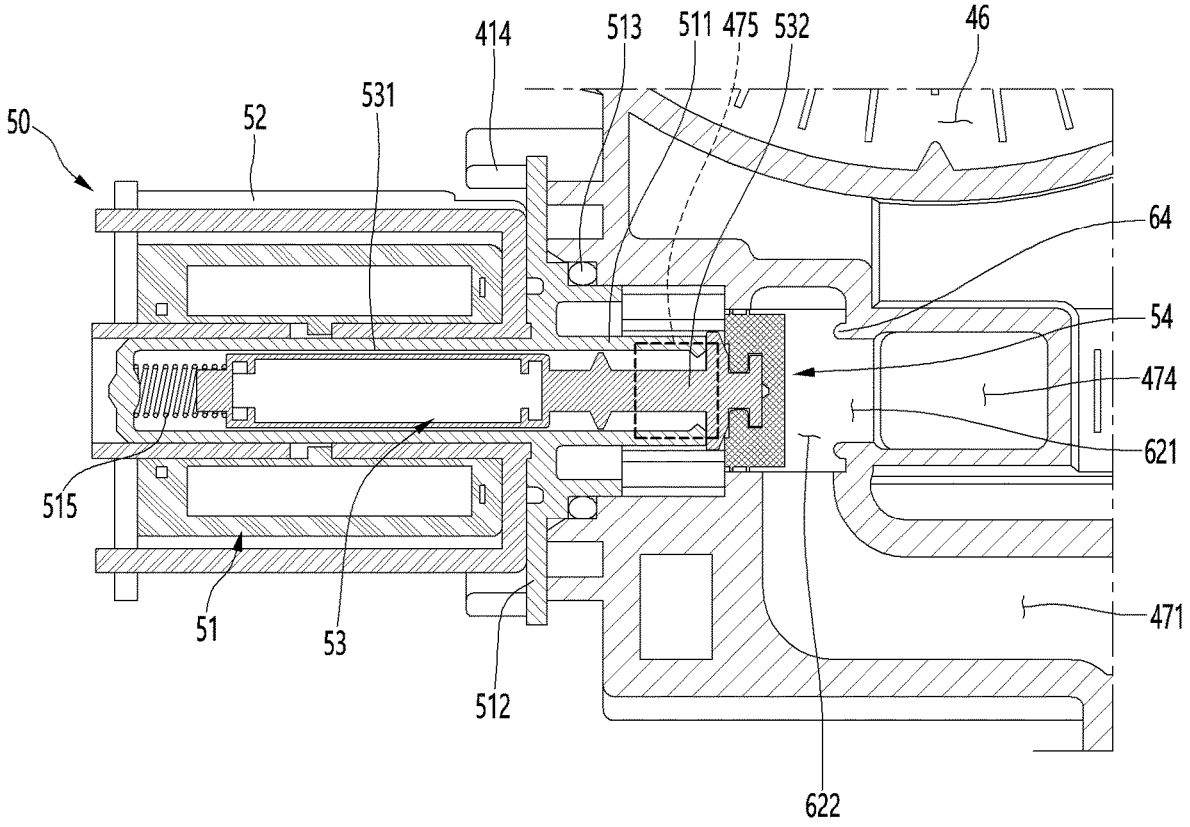
Figure 14:
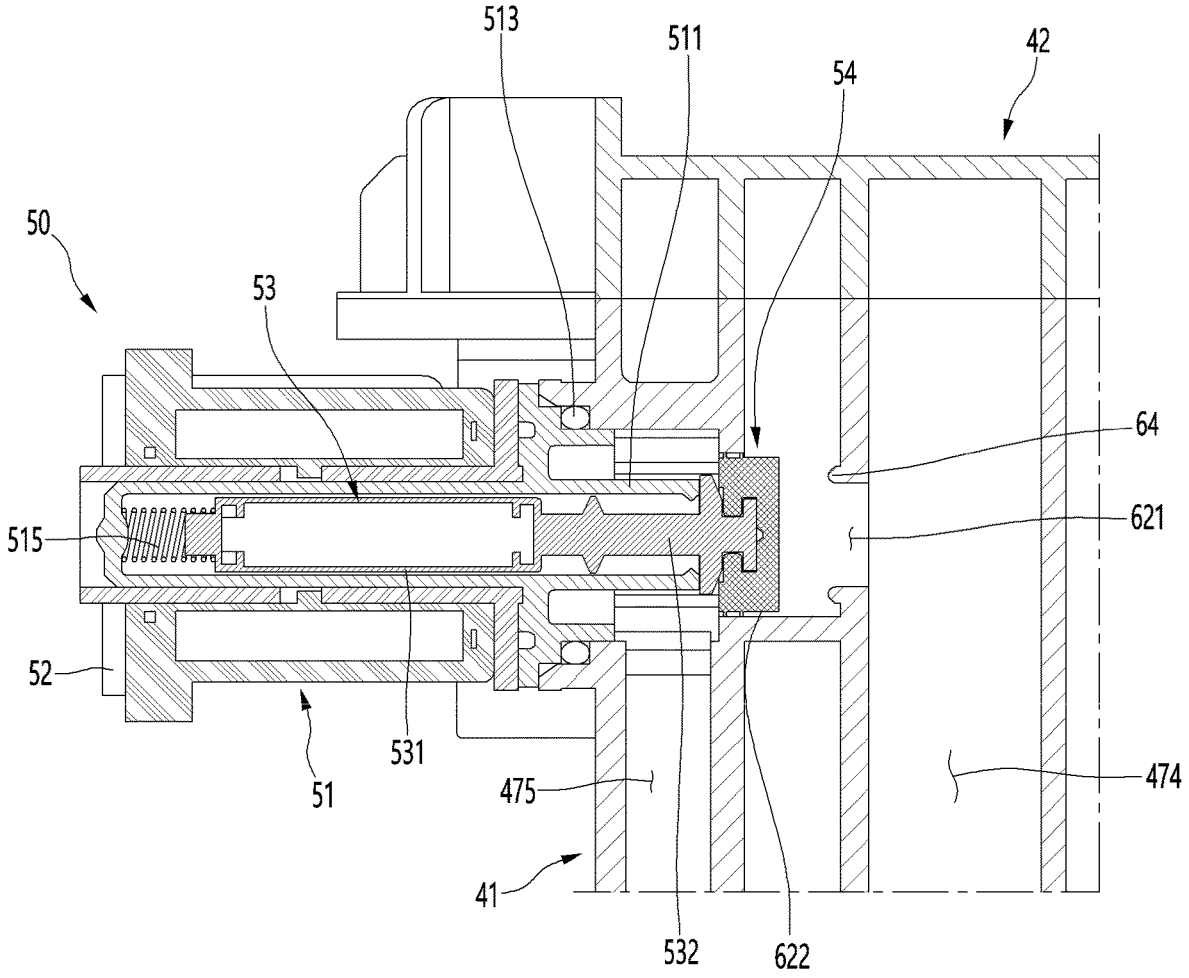

FIG. 13 is an enlarged view illustrating part A of FIG. 9 in a state where the switching valve is turned on, and FIG. 14 is an enlarged view illustrating part B of FIG. 10 in a state where the switching valve is turned on.

As illustrated in the drawing, in a state where the switching valve 50 is turned on, the spring 515 may be compressed while the rod 53 is moved rearward. In addition, the rod 53 may be moved rearward so that the head 54 may shield the exchange inlet 622. At this time, the head circumferential surface 542 is positioned inside the exchange inlet 622. In addition, the sealing rib 543 of the head circumferential surface 542 comes into contact with the inner surface of the exchange inlet 622 to shield the exchange inlet 622 and can seal between the head 54 and the exchange inlet 622.

In addition, in a state where the head 54 shields the exchange inlet 622, the regeneration inlet 621 is maintained in an open state. Accordingly, the water inflow flow path 471 is in communication with the regeneration inlet 621 and communicates with the regeneration inlet 621, the regeneration vertical flow path 474, and the regeneration tank 45 and thus may be in a state of being in capable of supplying water to the regeneration tank 45.

In other words, when the switching valve 50 is turned on by operation thereof, the head 54 is in a state of closing the exchange inlet 622 as illustrated in FIGS. 13 and 14, and the regeneration inlet 621 may be in an open state. In this state, the water flowing into The water softener 40 through the water inflow flow path 471 may be supplied to the inside of the regeneration tank 45.

As such, the regeneration inlet 621 or the exchange inlet 622 may be selectively shielded according to the operating state of the switching valve 50.

Meanwhile, in a state where the regeneration inlet 621 is shielded by the head 54, the inflow of water into the regeneration tank 45 is completely blocked so that the brine in the regeneration tank 45 can completely block the inflow into the inside of the exchange tank 46.

At this time, if the brine inside the regeneration tank 45 leaks and flows into the exchange tank 46 during normal operation for washing the dishes, stains may occur on the dishes due to the brine, so the regeneration inlet 621 should be able to ensure airtightness.

Hereinafter, the airtight structure of the regeneration inlet 621 will be described in more detail with reference to the drawings.

Figure 15:
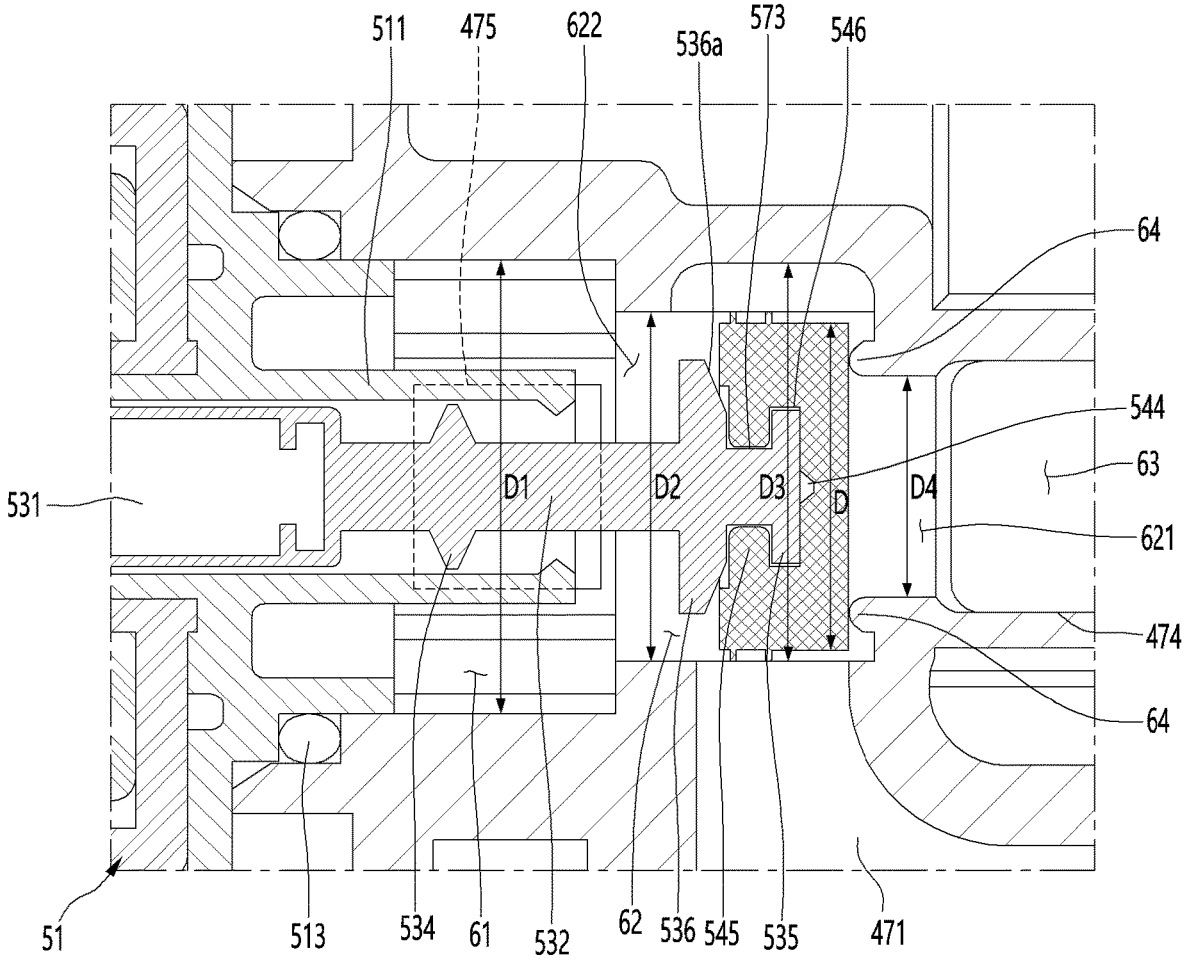
FIG. 15 is a cross-sectional view illustrating the relationship between the valve head and the flow path structure switched by the valve head.
Figure 16:
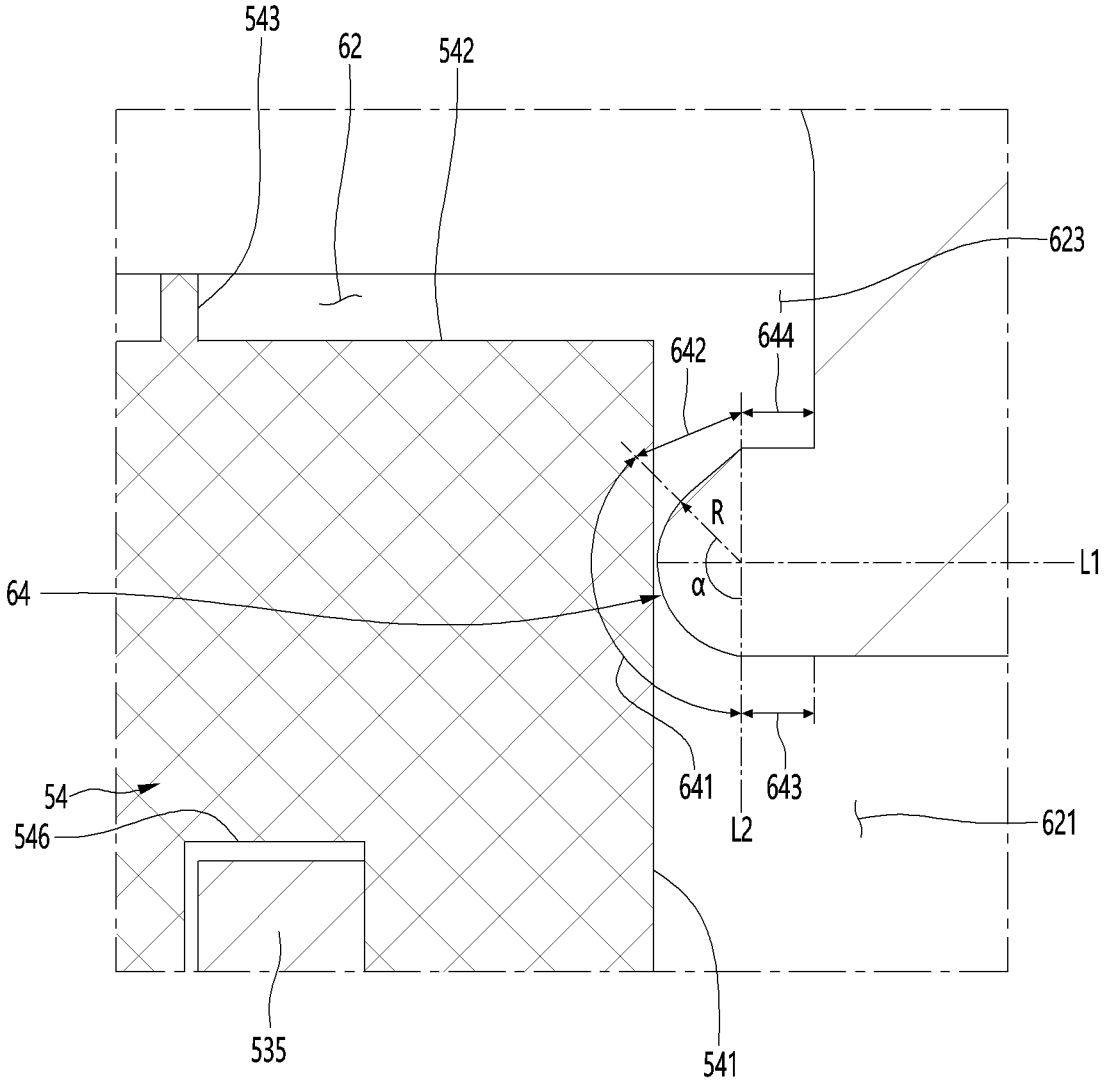
FIG. 16 is a view illustrating a contact state between the switching valve and the sealing protrusion.

FIG. 15 is a cross-sectional view illustrating the relationship between the valve head and the flow path structure switched by the valve head, and FIG. 16 is a view illustrating a contact state between the switching valve and the sealing protrusion.

As illustrated in the drawing, in a state where the switching valve 50 is mounted on the valve mounting part 413, the rod 53 may be inserted into the internal space of the valve mounting part 413, and the head 54 mounted on the end part of the rod 53 may be positioned between the regeneration inlet 621 and the exchange inlet 622. The space between the regeneration inlet 621 and the exchange inlet 622 in which the head 54 is positioned is a space in which the head 54 is positioned and thus may be referred to as a head accommodation part 62. The head accommodation part 62 may be referred to as a second space 62.

Meanwhile, referring to FIG. 15, looking at the internal structure of the tank body 41 to which the switching valve 50 is mounted, in more detail, the first space 61, the second space 62, and a third space 63 may be sequentially formed inside the valve mounting part 413. The first space 61, the second space 62, and the third space 63 may be disposed to be positioned on the same extension line as the center of the rod 53 and may be continuously disposed.

The rod guide 511 of the switching valve 50 may be accommodated in the first space 61, and the open upper end of the exchange vertical flow path 475 may be located in the first space 61. In addition, the second space 62 may communicate with the end part of the water inflow flow path 471. In addition, the third space 63 may communicate with the open upper end of the regeneration vertical flow path 474.

In addition, an exchange inlet 622 may be formed between the first space 61 and the second space 62, and the first space 61 and the second space 62 may be divided based on the exchange inlet 622. In addition, a regeneration inlet 621 may be formed between the second space 62 and the third space 63. The second space 62 and the third space 63 may be divided based on the regeneration inlet 621.

When the switching valve 50 is inserted and mounted, the valve head 54 can be inserted up to the second space 62, and thus the inner diameters of the first space 61 and the exchange inlet 622 and the second space 62 may be formed to be larger than the diameter of the head 54.

In this case, the first space 61 may be formed in a size in which the front end of the switching valve 50 can be inserted and mounted. In addition, the second space 62 is formed to be larger than the size of the regeneration inlet 621 and the exchange inlet 622 so that the water flowing therein through the water inflow flow path 471 can smoothly flow toward the regeneration inlet 621 or the exchange inlet 622. In addition, the head 54 is formed to shield the regeneration inlet 621, so that the inner diameters of the regeneration inlet 621 and the third space 63 may be formed to be smaller than the diameter of the head 54.

For example, based on the inner diameter D4 of the regeneration inlet 621, the inner diameter D1 of the first space 61 may be formed to have a size of 2 times, the inner diameter D2 of the exchange inlet 622 may be formed to have a size of 1.5 times, and the inner diameter D3 of the second space 62 may be formed to have a size of 1.8 times. In addition, the inner diameter D4 of the regeneration inlet 621 may be formed to have a size of approximately 9 mm.

Such a structure facilitates the inflow of water into the second space 62 and may ensure smooth movement of the head 54. In addition, according to the position of the head 54, selective water supply to the regeneration inlet 621 and the exchange inlet 622 may be smoothly performed.

Meanwhile, a sealing protrusion 64 may protrude around the regeneration inlet 621. The sealing protrusion 64 may be formed along the circumference of the regeneration inlet 621 and may protrude toward the head 54. Due to the formation of the sealing protrusion 64, the inner diameter D4 of the regeneration inlet 621 may be formed to be slightly smaller than the inner diameter of the third space 63.

In addition, the sealing protrusion 64 may protrude toward the second space 62, and the sealing protrusion 64 may protrude at a position spaced apart from the inner circumferential surface of the second space 62. Since the sealing protrusion 64 is formed to be separated from the inner circumferential surface of the second space 62 by a sufficient position, the sealing protrusion 64 does not cause defects during molding.

In detail, the tank body 41 may be injection-molded from a plastic material, and in the injection molding process of the tank body 41, the second space 62, the regeneration inlet 621, the sealing protrusion 64, or the like can be molded. At this time, if the sealing protrusion 64 is not separated from the inner circumferential surface of the second space 62 by a sufficient distance, there is a possibility that the sealing protrusion 64 may be molded defectively so that airtightness between the head 54 and the sealing protrusion 64 is not achieved, and thus a problem may occur that brine in the regeneration tank 45 flows into the exchange tank 46. In order to prevent such a problem, the sealing protrusion 64 may be spaced apart from the inner circumferential surface of the second space 62 by a distance that guarantees the moldability of the sealing protrusion 64.

In addition, the sealing protrusion 64 may protrude into the second space 62 to be in line contact with the head front surface 541. The sealing protrusion 64 may have a protruding shape to have a minimum contact area with the head front surface 541, so that sufficient pressure may be applied to the airtightness and airtight maintenance of the regeneration inlet 621 even with a small force. For example, the sealing protrusion 64 may protrude as much as 1.1 mm in height.

The sealing protrusion 64 may be formed in a shape to minimize a contact area while maintaining an airtight state with the head 54.

In detail, the sealing protrusion 64 may include a rounded part 641 and an inclined part 642. The rounded part 641 forms a portion in contact with the head 54 and may form the most protruding portion of the sealing protrusion 64. In other words, the protruding end part of the rounded part 641 may include the protruding central part of the sealing protrusion 64 and comes into contact with the head 54.

Due to the shape of the rounded part 641, the sealing protrusion 64 may have a sufficient round so that a molding defect due to air bubbles does not occur during injection molding. For example, the rounded part 641 may have a radius R of 0.5 mm. In addition, the rounded part 641 extends from the inner surface of the regeneration inlet 621 and may be formed over a set angle $\alpha$ region up to a point passing the center of the sealing protrusion 64. For example, the rounded part 641 may be formed up to an angle of about 120° with respect to the vertical extension line L2 passing through one end of the rounded part 641 and is formed at an angle of at least 90° or more, so that the rounded part 641 may extend to a point past the horizontal extension line L1 passing through the center.

When the head 54 is pressed into contact with the sealing protrusion 64, the rounded part 641 may be in close contact with the head 54 while making line contact, and airtightness between the head 54 and the sealing protrusion 64 will be ensured. In particular, since the protruding end part of the rounded part 641 is not in a planar shape parallel to the head front surface 541, the contact area with the head 54 can be reduced, and thus, a pressure may be provided so that the head 54 and the sealing protrusion 64 are sufficiently in close contact by only the elastic force of the spring 515.

In addition, since the rounded part 641 does not have a structure in which the protruding end part protrudes sharply, it is possible to always be molded to the correct size when the sealing protrusion 64 is molded and the generation of the mold defect can be prevented by entrapment of air bubbles at the protruding end part. In other words, airtightness between the head 54 and the sealing protrusion 64 may not be achieved even with a fine molding defect of the sealing protrusion 64, but due to the structure of the rounded part 641, the exact dimensions and shape of the sealing protrusion 64 are ensured to ensure the airtightness between the head 54 and the sealing protrusion 64.

Meanwhile, the inclined part 642 may extend from the end part of the rounded part 641 to the inside of the second space 62, that is, to the outside of the regeneration inlet 621. The inclined part 642 may be formed in a region not in contact with the head 54 when the head 54 and the sealing protrusion 64 come into contact with each other. The inclined part 642 may be formed to have an angle of approximately 30° to 60° with respect to the horizontal extension line L1.

A shape that minimizes a contact area when the head 54 and the sealing protrusion 64 come into contact with each other may be implemented by the inclined part 642. In other words, even when the head 54 is pressed and elastically deformed, the inclined part 642 does not come into contact with the head front surface 541 due to the shape of the inclined part 642, so that the contact area of the head 54 and the sealing protrusion 64 can be minimized. In addition, by securing the space 623 outside the inclined part 642 by the inclined part 642, the moldability of the sealing protrusion 64 may be further improved.

In addition, the sealing protrusion 64 may further include an inner extension part 643 and an outer extension part 644. The inner extension part 643 may extend parallel to the horizontal extension line L1 from the end part of the rounded part 641 and may form an inner surface of the regeneration inlet 621. In addition, the outer extension portion 644 extends parallel to the horizontal extension line L1 from the end part of the inclined part 642 and may form one surface spaced apart from the inner surface of the second space 62, that is, a portion of the outer surface of the sealing protrusion 64. The thickness of the sealing protrusion 64 can be formed uniformly by the outer extension part 644, and the moldability of the sealing protrusion 64 can be secured.

Meanwhile, the diameter of the head 54, that is, the diameter of the head front surface 541 may be formed to be larger than the outer end of the sealing protrusion 64 to protrude outward. Accordingly, when the head 54 comes into contact with the sealing protrusion 64, the head front surface 541 and the sealing protrusion 64 may be in contact with each other stably.

In addition, the first head fixing part 535 may be accommodated inside the fixing part receiving groove 546 of the inside of the head 54 to support the head 54 from the inside of the head 54. In addition, the diameter of the first head fixing part 535 may be formed to be smaller than the inner diameter D4 of the regeneration inlet 621.

A central groove 544 may be further formed in a central part of the fixing part receiving groove 546 in contact with the first head fixing part 535, and the central groove 544 may prevent the pressure applied by the first head fixing part 535 from being concentrated in the center of the head 54.

Meanwhile, an insertion protrusion 545 may be formed inside the head 54, and the insertion protrusion 545 is inserted inside the protrusion groove 537, so that the head 54 can be made to maintain in a state of being fixed to the end part of the rod 53.

In addition, the second head fixing part 536 may press and support the head 54 toward the sealing protrusion 64. The second head fixing part 536 may have a larger diameter than the inner diameter D4 of the regeneration inlet 621, so that the front surface of the head 54 is capable of being in stable contact with the sealing protrusion 64. In particular, the elastic force provided by the spring 515 can be uniformly applied to the entire surface of the head 54.

In addition, an inclined surface 536*a* may be formed around the second head fixing part 536, and when the sealing protrusion 64 and the head 54 come into contact by the inclined surface 536*a*, the outer end of the head 54 which is deformed backward may be formed to be effectively supported.

Due to this structure, in a state where the switching valve 50 is turned off, the head 54 is in close contact with the sealing protrusion 64 to completely block the regeneration inlet 621 to make the regeneration inlet 621 airtight.

Hereinafter, the operation of the dish washer 1 as described above will be described.

Figure 17:
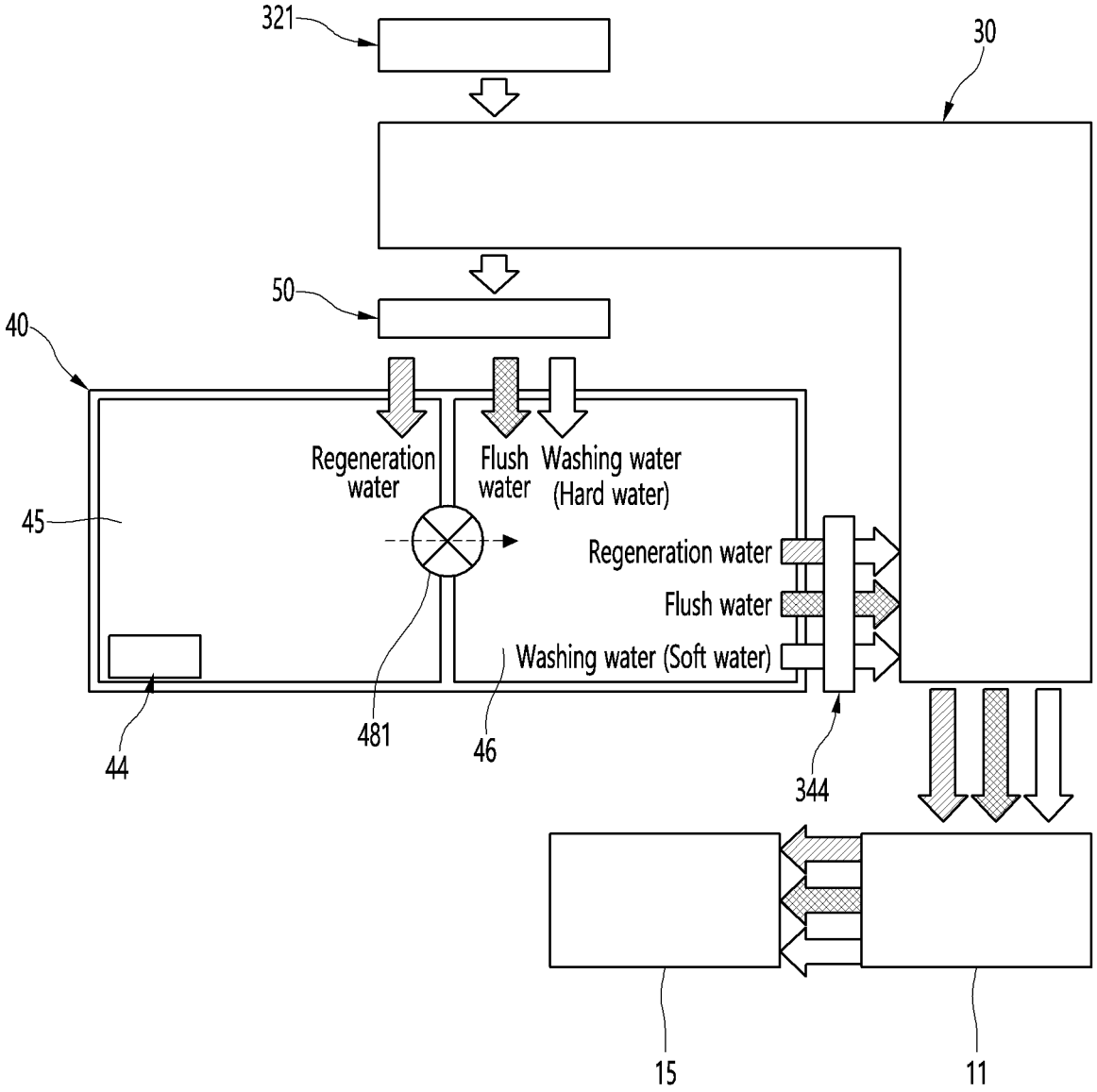
FIG. 17 is a block diagram schematically illustrating a water flow path of the dish washer with the water softener as the center.

FIG. 17 is a block diagram schematically illustrating a water flow path of the dish washer with the water softener as the center.

As illustrated in the drawing, when the user inputs washing conditions and manipulates the operation for the operation of the dish washer 1, the dish washer 1 performs a preliminary washing process and a main washing process, and the dishes are to be washed by performing a rinsing stroke to remove detergent from dishes and a drying cycle to remove water from the dishes.

In addition, when water is supplied to the dish washer 1, the water supply valve 344 is opened so that water from a water supply source such as tap water passes through the water jacket 30, the water softener 40, and the sump 14 and thus can be sprayed to the inside of the washing tank 11.

In detail, the water flowing into the water jacket 30 through the water supply connection part 32 of the water jacket 30 may be supplied to the water softener 40 through the connection part 34 at the lower end of the water jacket 30. In addition, the water supplied to The water softener 40 may be supplied to the exchange tank 46 or the regeneration tank 45 according to the operation of the switching valve 50. In other words, a regeneration water supply operation in which water is supplied to the regeneration tank 45 and a normal water supply operation in which water is supplied to the exchange tank 46 may be performed according to the operation of the switching valve 50.

During the normal water supply operation, water (washing water, hard water) of the water jacket 30 is supplied to the exchange tank 46, and the water inside the exchange tank can be softened by the ion exchange resin in the exchange tank 46. Then, the softened water (washing water, soft water) is again sprayed into the washing tank 11 via the water jacket 30 to wash dishes.

Water supplied during the operation of the dishwasher 1 passes through the exchange tank 46 and is supplied to the washing tank 11 in a softened state, so that water stains due to compounds of calcium do not occur on the dishes after washing and drying the dishes.

Meanwhile, the ion exchange resin has a property of increasing the volume while adsorbing metallic ions, such as compounds of calcium, contained in the washing water and decreasing the ability to adsorb metallic ions. The process of removing the metallic ions of the ion exchange resin is called regeneration of the ion exchange resin, and brine is used as regeneration water in this regeneration process.

In order to regenerate the ion exchange resin in the exchange tank 46, the switching valve 50 is operated to perform a regeneration water supply operation. During the regeneration water supply operation, water (regenerated water) of the water jacket 30 is supplied to the regeneration tank 45. Then, the water supplied to the regeneration tank 45 is mixed with the salt in the regeneration tank 45 to become brine (regenerated water) for regeneration of the ion exchange resin. In addition, the brine in the regeneration tank 45 may flow into the exchange tank 46 through the check valve 481.

In addition, the brine supplied into the exchange tank 46 may separate the metallic ions adsorbed on the ion exchange resin in the exchange tank 46 so that the ion exchange resin is regenerated.

Then, water is continuously supplied from the water jacket 30 to the regeneration tank 45 until the regeneration of the ion exchange resin is completed, and the ion exchange resin is regenerated while passing through the exchange tank 46 and then can be drained after passing through the inside of the water jacket 30 again.

Meanwhile, when the regeneration water supply operation is completed, the dish washer 1 can be switched back to the normal water supply operation, and water (flush water) of the water jacket 30 may be supplied to the exchange tank 46 in order to wash brine (washing water) remaining in the exchange tank 46. The water supplied to the exchange tank 46 may be drained after passing through the inside of the water jacket 30 again so that the brine inside the exchange tank 46 can be removed.

In addition, the water inside the washing tank 11 may be drained to the drain hose by driving the drain pump 15 connected to the sump 14 and discharged to the outside.

Hereinafter, the operation of the switching valve 50 during the normal water supply operation and the regeneration water supply operation and the change of the water flow path accordingly will be described in more detail.

Figure 18:
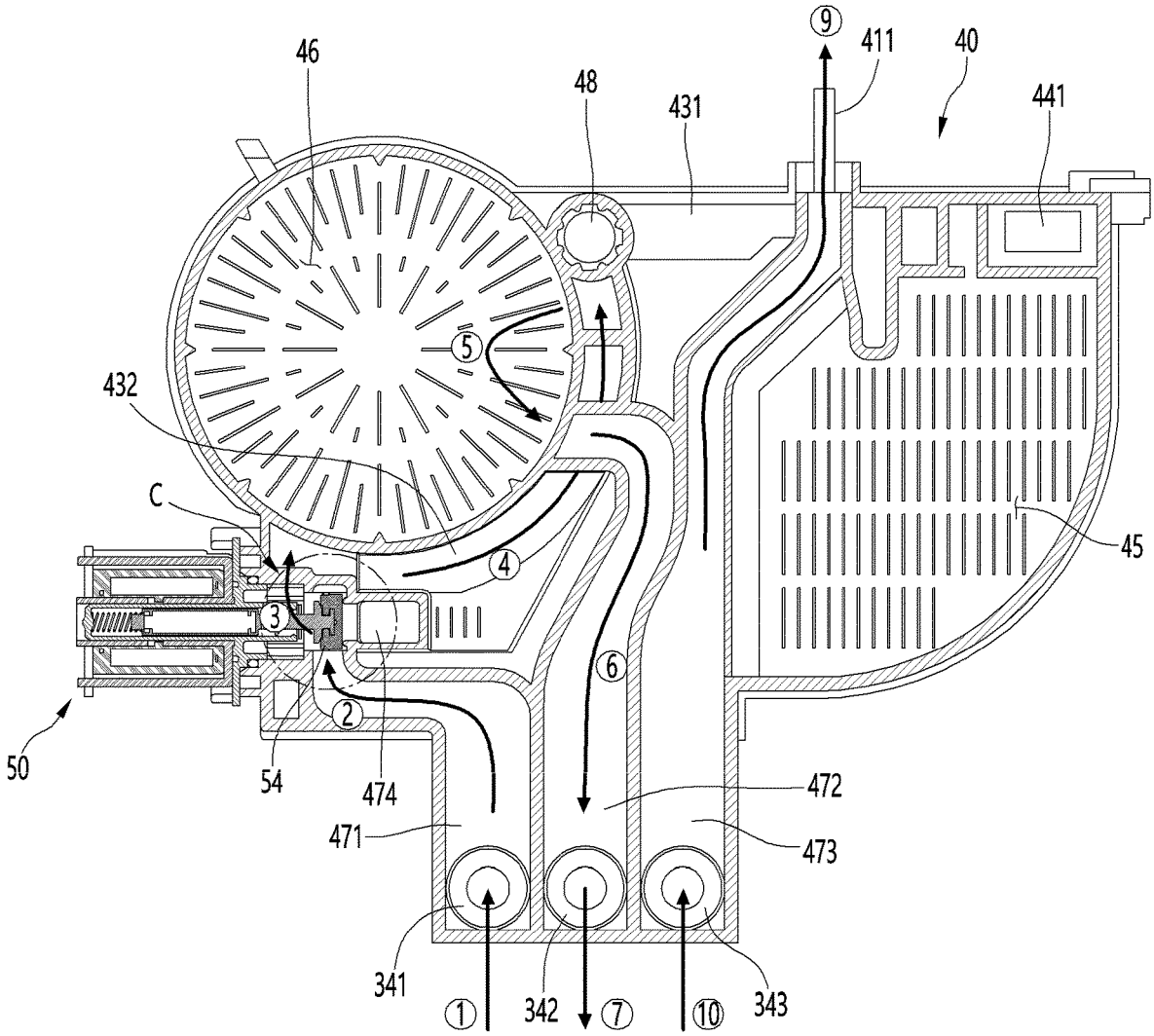
FIG. 18 is a view illustrating a water flow path during a normal water supply operation of the water softener.
Figure 19:
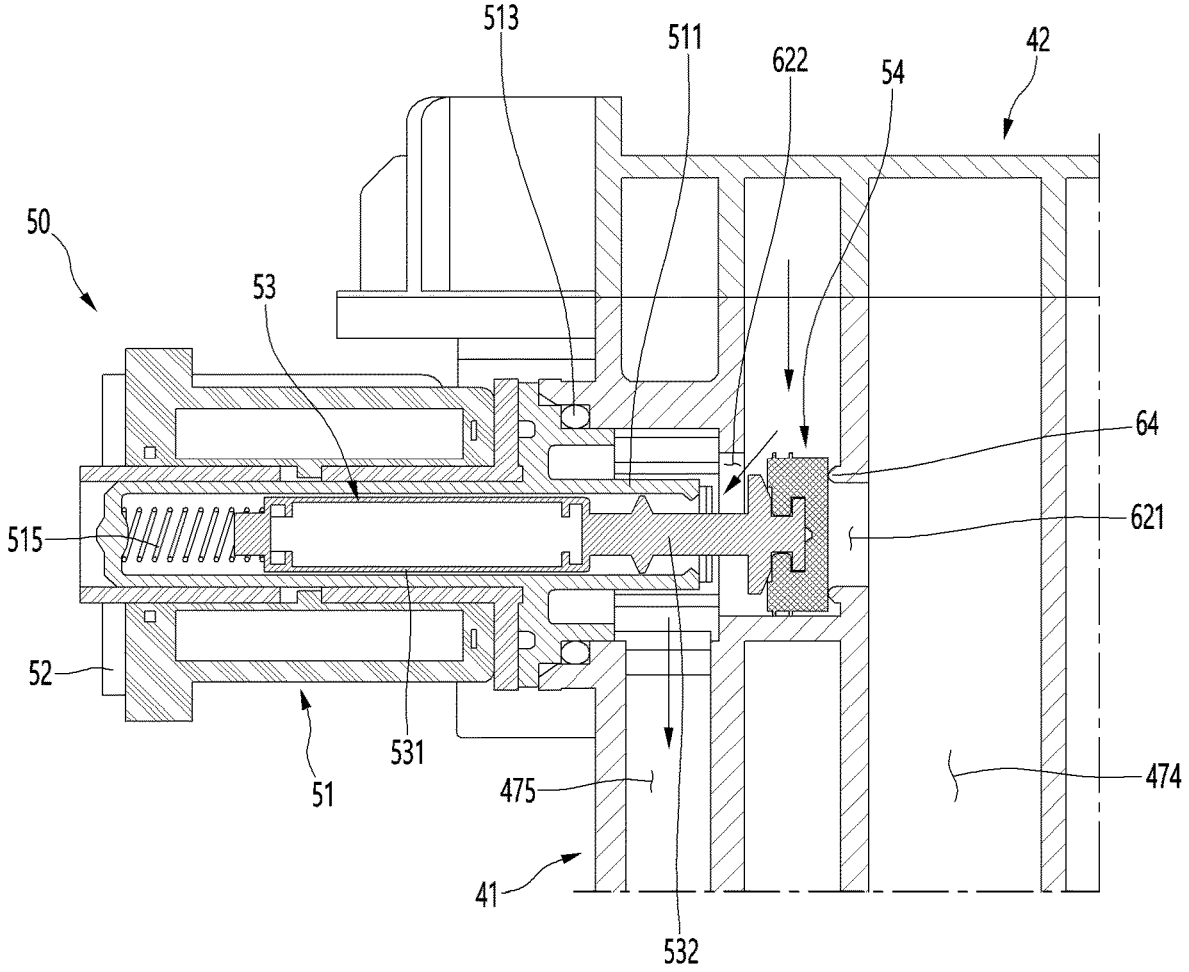
FIG. 19 is a view illustrating a flow path state and a water flow path by a switching valve in part C of FIG. 18.

In addition, FIG. 18 is a view illustrating a water flow path during a normal water supply operation of the water softener, and FIG. 19 is a view illustrating a flow path state and a water flow path by a switching valve in part C of FIG. 18.

As illustrated in the drawing, in a case where the dish washer 1 performs the normal water supply operation, the switching valve 50 maintains an off state to shield the regeneration inlet 621. In this case, the head 54 may seal the regeneration inlet 621 by line contact with the sealing protrusion 64. Accordingly, it is possible to prevent the brine from flowing into the exchange tank 46 or the flow path connected to the exchange tank 46 from the regeneration inlet side.

In addition, when the switching valve 50 is in an off state, the exchange inlet 622 is kept open. In this state, the water discharged from the water inflow connection part 341 of the water jacket 30 by the operation of the connection part valve 344 may flow into the exchange vertical flow path 475 through the water inflow flow path 471. In addition, water flowing downward through the exchange vertical flow path 475 may flow into the lower surface of the exchange tank 46 through the second base flow path 432.

The water supplied into the exchange tank 46 is softened by the ion exchange resin, and the softened water flows along the recovery flow path 472 communicating with the upper end of the exchange tank 46 and then may flow into the water jacket 30 again through the recovery connection part 342.

Then, the softening water flowing into the water jacket 30 flows into the water outflow flow path 473 through the water outflow connection part 343, and the water flowing along the water outflow flow path 473 may be discharged through the water outlet 411, flow in the sump 14, and be sprayed into the washing tank 11.

The flow path during the normal water supply operation may provide the same path even when water (flush water) of the water jacket 30 is supplied for brine washing of the exchange tank 46. In addition, the flush water discharged through the water outlet 411 may be drained through the drain hose without being sprayed into the washing tank 11.

Figure 20:
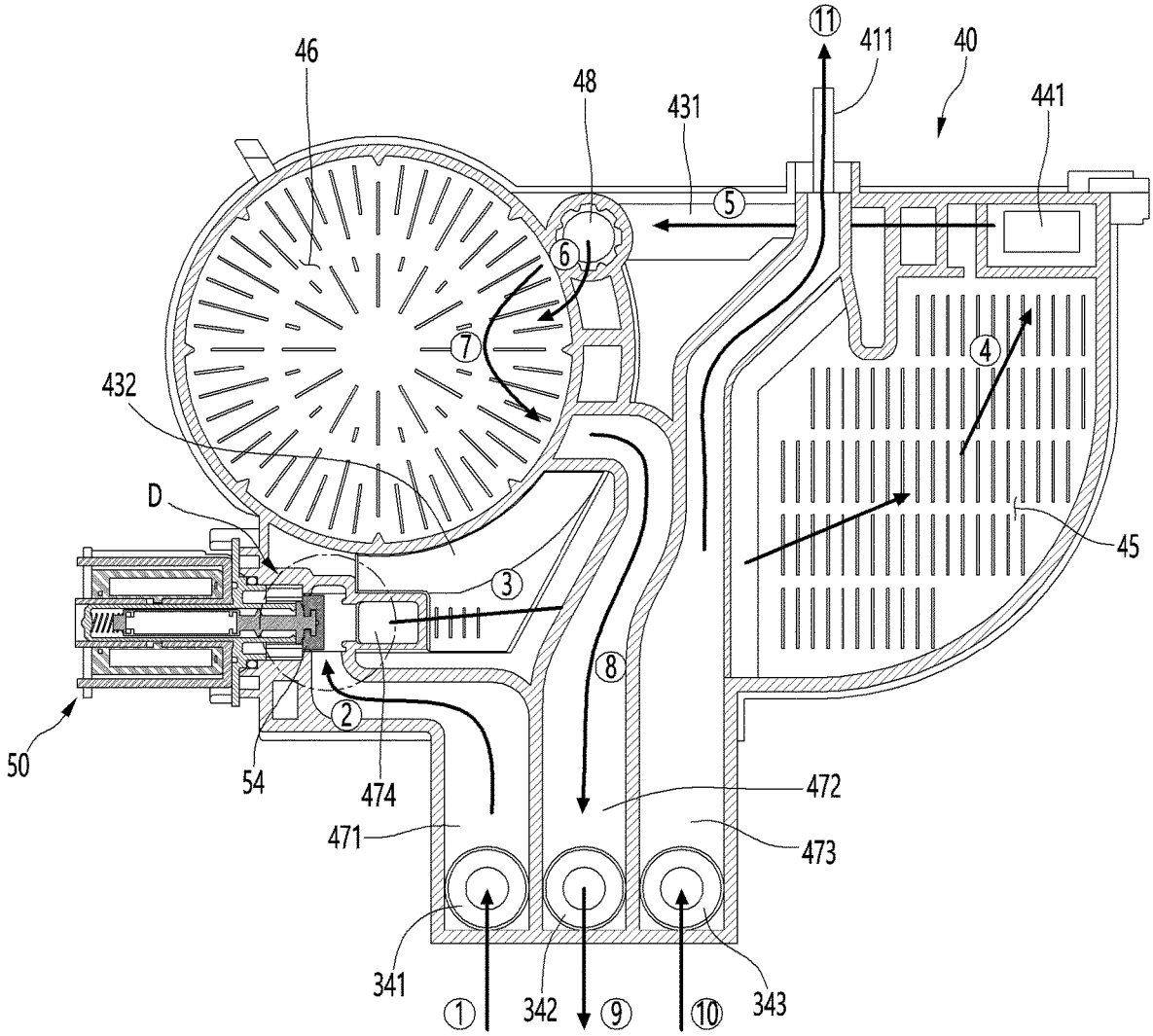
FIG. 20 is a view illustrating a water flow path during a regeneration water supply operation of the water softener.
Figure 21:
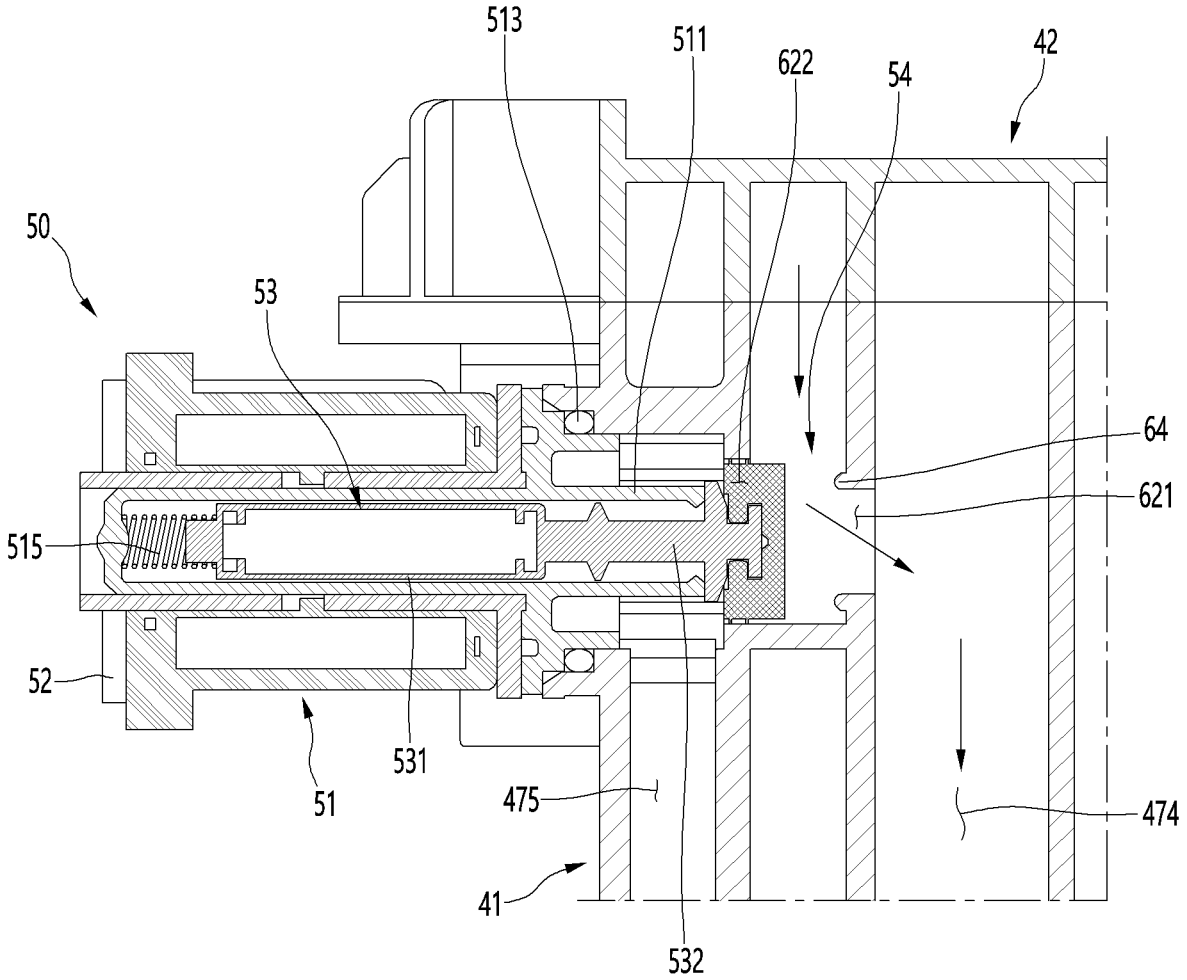
FIG. 21 is a view illustrating a flow path state and a water flow path by a switching valve in part D of FIG. 20.

FIG. 20 is a view illustrating a water flow path during a regeneration water supply operation of the water softener, and FIG. 21 is a view illustrating a flow path state and a water flow path by a switching valve in part D of FIG. 20.

As illustrated in the drawings, the dish washer performs a regeneration water supply operation every set period in order to maintain the performance of the ion exchange resin.

Although the regeneration water supply operation varies depending on the installation environment of the dish washer 1, in general, the regeneration water supply operation may be set to be performed at every cycle in which the performance degradation of the ion exchange resin occurs. For example, in an environment where tap water does not contain a lot of compounds of calcium, such as in Korea, the regeneration water supply operation may be performed once every two weeks, but the regeneration water supply operation may set a desired performing period according to the needs of the user.

In addition, when the concentration of brine in the regeneration tank 45 is lowered by the repeated regeneration water supply operation, an abnormality in the concentration of brine is detected by the detection device 44 so that the user can replenish salt in the regeneration tank.

In a case where the dish washer 1 performs the regeneration water supply operation, the switching valve 50 is turned on to shield the exchange inlet 622. At this time, the head 54 is positioned at the exchange inlet 622, and the sealing rib 543 of the head 54 contacts the inner surface of the exchange inlet 622 to shield the exchange inlet 622. At this time, the regeneration inlet 621 is in an open state.

Therefore, in this state, the water discharged from the water inflow connection part 341 of the water jacket 30 by the operation of the connection part valve 344 may pass through the water inflow flow path 471 and flow into the regeneration vertical flow path 474. In addition, water flowing downward through the regeneration vertical flow path 474 may flow into the regeneration tank 45.

The water flowing into the regeneration tank 45 may be brine by dissolving salt and flows to the connection flow path 48 along the first base flow path 431. In addition, the water flowing into the connection flow path 48 may flow into the exchange tank 46 through the check valve 481 that is opened in one direction.

The water (regenerated water, brine) flowing into the exchange tank 46 regenerates the ion exchange resin inside the exchange tank 46. By continuous water supply to the exchange tank 46, the water in the exchange tank 46 flows into the recovery flow path 472, and, through the recovery connection part 342 connected to the recovery flow path 472, flows into the water jacket 30.

In addition, the water flowing into the water jacket 30 flows into the water outflow flow path 473 through the water outflow connection part 343, and the water flowing along the water outflow flow path 473 may be discharged through the water outlet 411 and may be discharged to the outside through the sump 14 and the drain hose.

The regeneration water supply operation may be continued until the regeneration of the ion exchange resin inside the exchange tank 46 is completed, and when the regeneration water supply operation is ended, the switching valve 50 is turned off as illustrated in FIG. 18 again to switch the flow path and thus normal water supply operation can be performed.

The following effects can be expected in the dish washer and the water softener for the dish washer according to the proposed embodiment.

The switching valve that switches the flow path through which water is supplied to the regeneration tank and the exchange tank inside the water softener maintains the state where the regeneration inlet connected to the regeneration tank is shielded during normal water supply operation to soften the washing water.

In particular, in order to improve the airtightness of the regeneration inlet by the switching valve, a sealing protrusion is formed along the circumference of the regeneration inlet, and the sealing protrusion and the head of the switching valve are brought into contact to minimize the contact area, thereby improving airtight performance.

In detail, since the front surface of the planar head and the protruding sealing protrusion come into line contact with each other, the regeneration inlet can be shielded in an airtight state with a minimum contact area.

Accordingly, even with a small force provided by the spring, the pressure between the head and the sealing protrusion for airtightness can be sufficiently applied, and thus, it is possible to completely block the leakage of brine from the regeneration tank to the regeneration inlet. In addition, according to this, there is an advantage in that it is possible to completely prevent contamination such as stains due to leakage of brine to the dishes being washed, thereby guaranteeing the washing performance of the dishes.

In addition, by minimizing the contact area with the line contact structure between the head and the sealing protrusion, it is possible to prevent foreign matter from being caught between the head and the sealing protrusion and not being airtight, and there is an advantage in that it is possible to ensure the shielding performance of the regeneration inlet.

In addition, the sealing protrusion may protrude at a position spaced apart from the inner surface of the space in which the head is accommodated, thus there is an advantage in that it is possible to prevent a molding defect of the sealing protrusion formed during injection molding of the tank body to ensure airtight contact between the head and the sealing protrusion.

In addition, since a portion of the sealing protrusion in contact with the head is formed in a rounded shape, air bubbles are filled in the protruding end part of the sealing protrusion when the sealing protrusion is molded, thereby preventing defects of the sealing protrusion from occurring. In other words, there is an advantage in that the airtight performance is maintained by preventing a molding defect of a portion in contact with the head and ensuring moldability.

In addition, since the portion in contact with the head is formed in a rounded shape, it is possible to prevent damage or permanent deformation of the head even during long-term and repeated pressing, thereby maintaining airtight performance.

In addition, an inclined part inclined at an end part of the rounded part may be formed on the outer surface of the sealing protrusion. Due to the inclined part, the head is brought into contact only in the rounded part region, thereby minimizing the contact area.

In addition, by reducing the thickness of a portion of the sealing protrusion that does not come in contact with the head, a space between the sealing protrusion and the inner surface of the space in which the head is accommodated can be secured, the moldability of the sealing protrusion can be improved and molding defects can be prevented.

In addition, a first head fixing part for supporting the head from the inside and a second head fixing part for supporting the head from the outside are formed on the rod on which the head is mounted, so that the head has a more stable mounting structure.

In particular, a diameter of the first head fixing part may be smaller than an inner diameter of the regeneration inlet, and a diameter of the second head fixing part may be formed larger than an inner diameter of the regeneration inlet. Accordingly, there is an advantage in that the airtightness is maintained by maintaining a stable contact state with the sealing protrusion without excessive deformation of the head.

In addition, a sealing rib is formed on the circumferential surface of the head, and the exchange inlet may be sealed by the sealing rib in a state where the head is inserted into the exchange inlet. Accordingly, there is an advantage in that the mobility of the head is ensured, and airtightness in the exchange inlet is secured.

What is claimed is:

1. A dishwasher comprising:

a main body that defines a washing space configured to receive an object to be washed;

a door configured to open and close the washing space;

a water jacket disposed at a side wall of the main body and configured to store water for washing the object;

a water softener connected to the water jacket and configured to soften the water supplied from the water jacket;

a sump connected to the water softener and disposed at a bottom of the washing space, the sump being configured to collect water in the washing space; and a nozzle connected to the sump and configured to spray water into the washing space, wherein the water softener comprises:

a tank body comprising:

a regeneration tank configured to accommodate brine, an exchange tank configured to accommodate an ion exchange resin, and a flow path configured to supply water to the regeneration tank and the exchange tank, the flow path including a regeneration inlet in fluid communication with the regeneration tank and an exchange inlet in fluid communication with the exchange tank, a switching valve disposed at the tank body and configured to selectively open and close the regeneration inlet or the exchange inlet to thereby switch the flow path, the switching valve comprising a head configured to open and close the regeneration inlet and the exchange inlet, and a sealing protrusion that protrudes from a circumference of the regeneration inlet toward the regeneration inlet, the sealing protrusion being configured to contact the head based on the head closing the regeneration inlet, and wherein the sealing protrusion comprises:

a rounded part that extends radially outward from the circumference of the regeneration inlet and extends around a protruding end of the sealing protrusion, the protruding end being configured to contact the head, and an inclined part that extends radially outward from an outer end of the rounded part in a direction inclined with respect to a surface of the head.

2. The dishwasher of claim 1, wherein the water softener further comprises:

a tank cover that covers an upper surface of the tank body; and a tank base that covers a lower surface of the tank body, and wherein at least a portion of the flow path is defined at each of the tank cover and the tank base.

3. The dishwasher of claim 2, wherein the tank body comprises a water outlet connected to the sump, wherein the flow path comprises:

a water inflow path in fluid communication with a space between the regeneration inlet and the exchange inlet, the water inflow path being configured to supply the water of the water jacket to the space between the regeneration inlet and the exchange inlet, a recovery flow path connected to the exchange tank and configured to guide water in the exchange tank to the water jacket, and a water outflow path that connects the water jacket to the water outlet of the tank body and is configured to discharge the water from the water jacket to the sump, wherein the tank cover covers upper surfaces of the water inflow path, the recovery flow path, and the water outflow path, and wherein the tank cover defines:

a water inflow port that is connected to the water jacket and open to the water inflow path, a recovery port that is connected to the water jacket and open to the recovery flow path, and a water outflow port that is connected to the water jacket and open to the water outflow path.

4. The dishwasher of claim 1, wherein the tank body has a head accommodation space that is defined between the regeneration inlet and the exchange inlet and accommodates the head, the head being configured to move in the head accommodation space, and wherein the sealing protrusion is spaced apart from a circumference of the head accommodation space.

5. The dishwasher of claim 1, wherein the regeneration inlet and the exchange inlet face each other, and wherein the head is configured to selectively open and close one of the regeneration inlet or the exchange inlet based on the head linearly reciprocating between the regeneration inlet and the exchange inlet.

6. The dishwasher of claim 5, wherein an inner diameter of the exchange inlet is greater than an inner diameter of the regeneration inlet, and wherein the head is configured to:

close the regeneration inlet based on the head moving to and contacting the sealing protrusion, and close the exchange inlet based on the head moving away from the sealing protrusion and inserting into the exchange inlet.

7. The dishwasher of claim 6, wherein the head comprises a sealing rib that protrudes from a circumferential surface of the head and extends along the circumferential surface of the head, the sealing rib being configured to contact an inner surface of the exchange inlet to thereby block a gap between the head and the exchange inlet.

8. The dishwasher of claim 1, wherein the rounded part has a contact surface defined at the protruding end of the sealing protrusion, and wherein the inclined part is configured to be spaced apart from the surface of the head based on the contact surface of the rounded part being in contact with the head.

9. The dishwasher of claim 1, wherein the sealing protrusion further comprises:

an inner extension part that extends from an inner end of the rounded part and defines an inner surface of the regeneration inlet; and an outer extension part that extends parallel to the inner extension part from an outer end of the inclined part and defines at least a portion of an outer surface of the sealing protrusion.

10. The dishwasher of claim 1, wherein the regeneration inlet and the exchange inlet face each other, and wherein the flow path comprises an inflow path that is in communication with a space between the regeneration inlet and the exchange inlet and configured to supply water to the space between the regeneration inlet and the exchange inlet.

11. A dishwasher comprising:

a main body that defines a washing space configured to receive an object to be washed;

a door configured to open and close the washing space;

a water jacket disposed at a side wall of the main body and configured to store water for washing the object;

a water softener connected to the water jacket and configured to soften the water supplied from the water jacket;

a sump connected to the water softener and disposed at a bottom of the washing space, the sump being configured to collect water in the washing space; and a nozzle connected to the sump and configured to spray water into the washing space, wherein the water softener comprises:

a tank body comprising:

a regeneration tank configured to accommodate brine, an exchange tank configured to accommodate an ion exchange resin, and a flow path configured to supply water to the regeneration tank and the exchange tank, the flow path including a regeneration inlet in fluid communication with the regeneration tank and an exchange inlet in fluid communication with the exchange tank, a switching valve disposed at the tank body and configured to selectively open and close the regeneration inlet or the exchange inlet to thereby switch the flow path, the switching valve comprising a head configured to open and close the regeneration inlet and the exchange inlet, and a sealing protrusion that protrudes from a circumference of the regeneration inlet toward the regeneration inlet, the sealing protrusion being configured to contact the head based on the head closing the regeneration inlet, wherein the switching valve further comprises:

a valve body, a rod disposed inside the valve body and configured to move linearly along the valve body, and a spring that is disposed inside the valve body and elastically supports the rod, and wherein the head is made of a deformable material and disposed at an end portion of the rod.

12. The dishwasher of claim 11, wherein the rod comprises:

a first head fixing part that is disposed at the end portion of the rod and configured to support the head from an inside of the head based on the head contacting the sealing protrusion; and a second head fixing part that is spaced apart from the first head fixing part and protrudes from the rod, the second head fixing part being configured to support the head from an outside of the head, and wherein the rod defines a protrusion groove between the first head fixing part and the second head fixing part, the protrusion groove receiving a portion of the head.

13. The dishwasher of claim 12, wherein a diameter of the first head fixing part is less than a diameter of the regeneration inlet, and wherein a diameter of the second head fixing part is greater than the diameter of the regeneration inlet.

14. The dishwasher of claim 13, wherein the diameter of the second head fixing part is less than a diameter of an outer end of the sealing protrusion.

15. The dishwasher of claim 11, wherein the tank body defines a valve mounting space that accommodates the switching valve, the valve mounting space being open to an outside of the tank body, and wherein the head is inserted into the valve mounting space from the outside of the tank body.

16. The dishwasher of claim 15, wherein the tank body further comprises a valve restraint part that are disposed at a side of the valve mounting space and fixes the switching valve to the tank body, and wherein the valve body comprises a fixing part disposed at a side of the valve body and coupled to the valve restraint part.

17. The dishwasher of claim 15, wherein the valve mounting space comprises:

a first space that receives the rod and includes a first flow path connected to the exchange tank;

a second space that receives the head; and a third space that includes a second flow path connected to the regeneration tank, and wherein the first space, the second space, and the third space are arranged along an insertion direction of the switching valve into the tank body, the insertion direction being parallel to a central axis of the rod.

18. The dishwasher of claim 17, wherein the first flow path of the first space includes an exchange vertical flow path that extends vertically toward a bottom surface of the tank body and is connected to the exchange tank, wherein the second flow path of the third space includes a regeneration vertical flow path that extends vertically toward the bottom surface of the tank body and is connected to the regeneration tank, and wherein the tank body further defines an inflow path that is connected to the second space between the first space and the third space, the inflow path being configured to supply washing water to the second space.

* * * * *